US008456405B2

(12) United States Patent
Oohira

(10) Patent No.: US 8,456,405 B2
(45) **Date of Patent: *Jun. 4, 2013**

(54) LIQUID CRYSTAL DISPLAY DEVICE AND DRIVING METHOD OF THE SAME

(75) Inventor: Tomohide Oohira, Mobara (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 699 days.

This patent is subject to a terminal disclaimer.

(21) Appl. No.: 12/623,159

(22) Filed: Nov. 20, 2009

(65) Prior Publication Data

US 2010/0066728 A1 Mar. 18, 2010

Related U.S. Application Data

(63) Continuation of application No. 11/605,449, filed on Nov. 29, 2006, now Pat. No. 7,643,001, which is a continuation of application No. 10/214,578, filed on Aug. 9, 2002, now Pat. No. 7,145,544.

(30) Foreign Application Priority Data

Sep. 18, 2001 (JP) ..... 2001-282826

(51) Int. Cl.
*G09G 3/36* (2006.01)

(52) U.S. Cl.
USPC ..... 345/99; 345/89; 345/94

(58) Field of Classification Search
USPC ..... 345/87–104, 204
See application file for complete search history.

(56) References Cited

U.S. PATENT DOCUMENTS

| | | | |
|---|---|---|---|
| 5,657,039 | A | 8/1997 | Mizukata |
| 5,699,076 | A | 12/1997 | Tomiyasu |
| 5,731,798 | A | 3/1998 | Shin |
| 5,742,269 | A | 4/1998 | Hayashiguchi |
| 6,600,469 | B1 | 7/2003 | Nukiyama et al. |
| 7,145,544 | B2 | 12/2006 | Oohira |

FOREIGN PATENT DOCUMENTS

| | | |
|---|---|---|
| JP | 04-249291 | 4/1992 |
| JP | 05-313607 | 11/1993 |
| JP | 11-231843 | 8/1999 |
| JP | 11-296148 | 10/1999 |
| JP | 2000-338936 | 12/2000 |

*Primary Examiner* — Regina Liang
(74) *Attorney, Agent, or Firm* — Antonelli, Terry, Stout & Kraus, LLP.

(57) ABSTRACT

A liquid crystal display device and driving method therefor are disclosed. The device includes a plurality of signal lines that apply different gray scale voltages to each of the pixels. A driving circuit is provided to generate the gray scale voltages to be applied to the pixels. In operation, the driving circuit applies the first gray scale voltage at intervals of the horizontal scanning time within a display period. The second gray scale voltage is output by a number of times that is not smaller than twice and not greater than (M-N) times at intervals of the horizontal scanning time from the beginning of the vertical retrace interval. The second gray scale voltage is then stopped until completion of the vertical retrace interval.

14 Claims, 18 Drawing Sheets

SEQUENCE OF THE LIQUID CRYSTAL DRIVER (EXAMPLE)

LIQUID CRYSTAL DISPLAY DEVICE AND DRIVING METHOD OF THE SAME

CROSS REFERENCE TO RELATED APPLICATION

This is a Continuation application of U.S. patent application Ser. No. 11/605,449, filed Nov. 29, 2006, now U.S. Pat. No. 7,643,001 which is a Continuation application of U.S. patent application Ser. No. 10/214,578, filed Aug. 9, 2002, now U.S. Pat. No. 7,145,544, the contents of which are incorporated herein by reference.

BACKGROUND OF THE INVENTION

The present invention relates to a liquid crystal display device and to a method of driving the same; and, more particularly, the invention relates to a technique applicable to a driving method which applies a gray scale voltage to video signal lines within a vertical retrace interval.

Active matrix liquid crystal display devices, which have active elements (for example, thin film transistors) for individual pixels and in which the active elements are driven in a switching manner, are widely used as display devices for notebook types of personal computers (hereinafter referred to simply as personal computer(s)).

A TFT type of liquid crystal display module represents an example of one kind of active matrix liquid crystal display device. The TFT type of liquid crystal display module includes a TFT (Thin Film Transistor) type of liquid crystal display panel (TFT-LCD), drain drivers disposed on a longer side of the liquid crystal display panel, and gate drivers and an interface part, each of which is disposed on a shorter side of the liquid crystal display panel. In general, the drain drivers are driven on the basis of driving signals received from a display control device (or timing controller) provided in the interface part.

In the above-described type of liquid crystal display module, the interval from the completion of line scanning in the n-th frame until the start of line scanning in the next (n+1)-th frame is called a vertical retrace interval, and the line scanning period in each frame is called a display period.

One type of liquid crystal display module is constructed to output a gray scale voltage for displaying white or black from its drain drivers to its drain signal lines at intervals of one line scanning period within the vertical retrace interval, so that voltages written in its pixels are prevented from being varied, which causes lateral stripes on the display screen, owing to leakage currents from the thin film transistors of the pixels within the vertical retrace interval. Namely, in such a liquid crystal display module, even within the vertical retrace interval, a driving signal is transmitted from a display control device provided in its interface part to the drain drivers to drive the drain drivers.

However, if synchronizing signals inputted from the outside (for example, a computer host) vary and the vertical retrace interval varies, contention occurs between a driving signal transmitted from the display control circuit to the drain drivers within the vertical retrace interval and a driving signal transmitted from the display control circuit to the drain drivers within the display period of the next frame after the completion of the vertical retrace interval. This leads to the problem that the drain drivers malfunction, and, in the worst case, the drain drivers are destroyed.

The present invention has been made to solve the aforementioned problem, and it provides a technique by which, even when the vertical retrace interval varies, in a liquid crystal display device and a driving method thereof, it is possible to prevent contention from occurring between a driving signal transmitted from a display control circuit to a driving circuit within the vertical retrace interval and a driving signal transmitted from the display control circuit to the driving circuit within the display period of the next frame after the completion of the vertical retrace interval.

The invention also provides a technique by which, in the liquid crystal display device and the driving method thereof, it is possible to prevent the voltages written in pixels from being varied, so as to prevent lateral stripes from being generated on the display screen, thereby improving the display quality of the display screen.

The above and other novel features of the invention will become apparent from the following description of the invention when taken in conjunction with the accompanying drawings.

SUMMARY OF THE INVENTION

Representative aspects of the invention disclosed in the present application will be described below in brief.

Namely, the invention provides a liquid crystal display device having a plurality of pixels, a plurality of signal lines which apply a gray scale voltage to each of the pixels, and a driving circuit which outputs a gray scale voltage to each of the signal lines, as well as a method of driving the liquid crystal display device. In the liquid crystal display device and the driving method thereof, a gray scale voltage is outputted from the driving circuit to each of the signal lines by a number of times not smaller than twice and not greater than (M-N) times within a vertical retrace interval, where M represents a value obtained by dividing the vertical retrace interval by a regular horizontal scanning time and rounding up fractions to the nearest whole number, and N represents an integer not smaller than one.

According to the invention, the gray scale voltage is outputted from the driving circuit to each of the signal lines by a number of times not smaller than twice and not greater than (M-N) times within a vertical retrace interval, where M represents a value obtained by adding together the number of lines each having a period scanned entirely and the number of lines each having a period scanned at least partly, when scanning is performed with the regular horizontal scanning time within the vertical retrace interval, and N represents an integer not smaller than one.

Particularly, in accordance with the invention, it is preferable that the gray scale voltage be outputted from the driving circuit to each of the signal lines by a number of times not smaller than M/2 times and not greater than (M-N) times within the vertical retrace interval. In this case, it is preferable that the gray scale voltage be outputted from the driving circuit to each of the signal lines within the vertical retrace interval in synchronism with a regular horizontal synchronizing signal or an internally generated horizontal reference signal.

In addition, in accordance with the invention, it is preferable that, when the gray scale voltage is to be outputted from the driving circuit to each of the signal lines within the vertical retrace interval, the polarity of the gray scale voltage to be outputted is inverted at least once.

In addition, in accordance with the invention, it is preferable that the gray scale voltage to be outputted from the driving circuit to each of the signal lines within the vertical retrace interval be a gray scale voltage for displaying white or black.

The invention also provides a liquid crystal display device having a plurality of pixels, a plurality of signal lines which apply a gray scale voltage to each of the pixels, a driving circuit which outputs the gray scale voltage to a plurality of pixels, and a display control circuit which controls the driving circuit, as well as a method of driving the liquid crystal display device. The display control circuit includes a first circuit which detects a vertical retrace interval on the basis of an externally inputted horizontal synchronizing signal and generates first to M-th within-retrace-interval horizontal reference signals within the vertical retrace interval, a second circuit which generates a horizontal reference signal by masking the (M-N)-th and the following within-retrace-interval horizontal reference signals among the within-retrace-interval horizontal reference signals generated by the first circuit, where N represents an integer not smaller than one and (M-N) represents an integer not smaller than two, and a third circuit which generates a driving signal for driving the driving circuit, within the vertical retrace interval, on the basis of the horizontal reference signal outputted from the second circuit. The driving circuit outputs a gray scale voltage to each of the signal lines by a number of times not smaller than twice and not greater than (M-N) times within the vertical retrace interval on the basis of the driving signal.

The invention also provides a liquid crystal display device having a plurality of pixels, a plurality of signal lines which apply a gray scale voltage to each of the pixels, a driving circuit which outputs the gray scale voltage to a plurality of pixels, and a display control circuit which controls the driving circuit, as well as a method of driving the liquid crystal display device. The display control circuit includes a first circuit which detects a vertical retrace interval on the basis of an externally inputted display timing signal and generates first to M-th within-retrace-interval horizontal reference signals within the vertical retrace interval, a second circuit which generates a horizontal reference signal by masking the (M-N)-th and the following within-retrace-interval horizontal reference signals among the within-retrace-interval horizontal reference signals generated by the first circuit, where N represents an integer not smaller than one and (M-N) represents an integer not smaller than two, and a third circuit which generates a driving signal for driving the driving circuit, within the vertical retrace interval, on the basis of the horizontal reference signal outputted from the second circuit. The driving circuit outputs the gray scale voltage to each of the signal lines by a number of times not smaller than twice and not greater than (M-N) times within the vertical retrace interval on the basis of the driving signal.

In addition, in accordance with the invention, it is preferable that the horizontal reference signal outputted from the second circuit within the vertical retrace interval be not smaller than M/2 in number.

Furthermore, in accordance with the invention, it is preferable that the display control circuit also includes a fourth circuit which generates a within-display-period horizontal reference signal on the basis of an externally inputted display timing signal.

According to the invention, within a vertical retrace interval, the transmission of the driving signal from the display control device to the driving circuit is stopped one or more lines before line scanning for the next frame is started after the completion of the vertical retrace interval, whereby it is possible to prevent contention from occurring between a driving signal transmitted from the display control circuit to drain drivers within the vertical retrace interval and a driving signal transmitted from the display control circuit to the drain drivers within the display period of the next frame after the completion of the vertical retrace interval. Accordingly, it is possible to prevent the drain drivers from malfunctioning or being destroyed.

In addition, the drain drivers are driven by transmitting the driving signal from the display control device to the drain drivers within the vertical retrace interval without any contention between the driving signal transmitted from the display control circuit to the drain drivers within the vertical retrace interval and the driving signal transmitted from the display control circuit to the drain drivers within the display period of the next frame after the completion of the vertical retrace interval. Accordingly, it is possible to prevent the voltages written in pixels from being varied and to thereby prevent lateral stripes from being generated on the display screen of the liquid crystal display device, thereby improving the display quality of the display screen.

DESCRIPTION OF THE PREFERRED EMBODIMENTS

Figure 1:
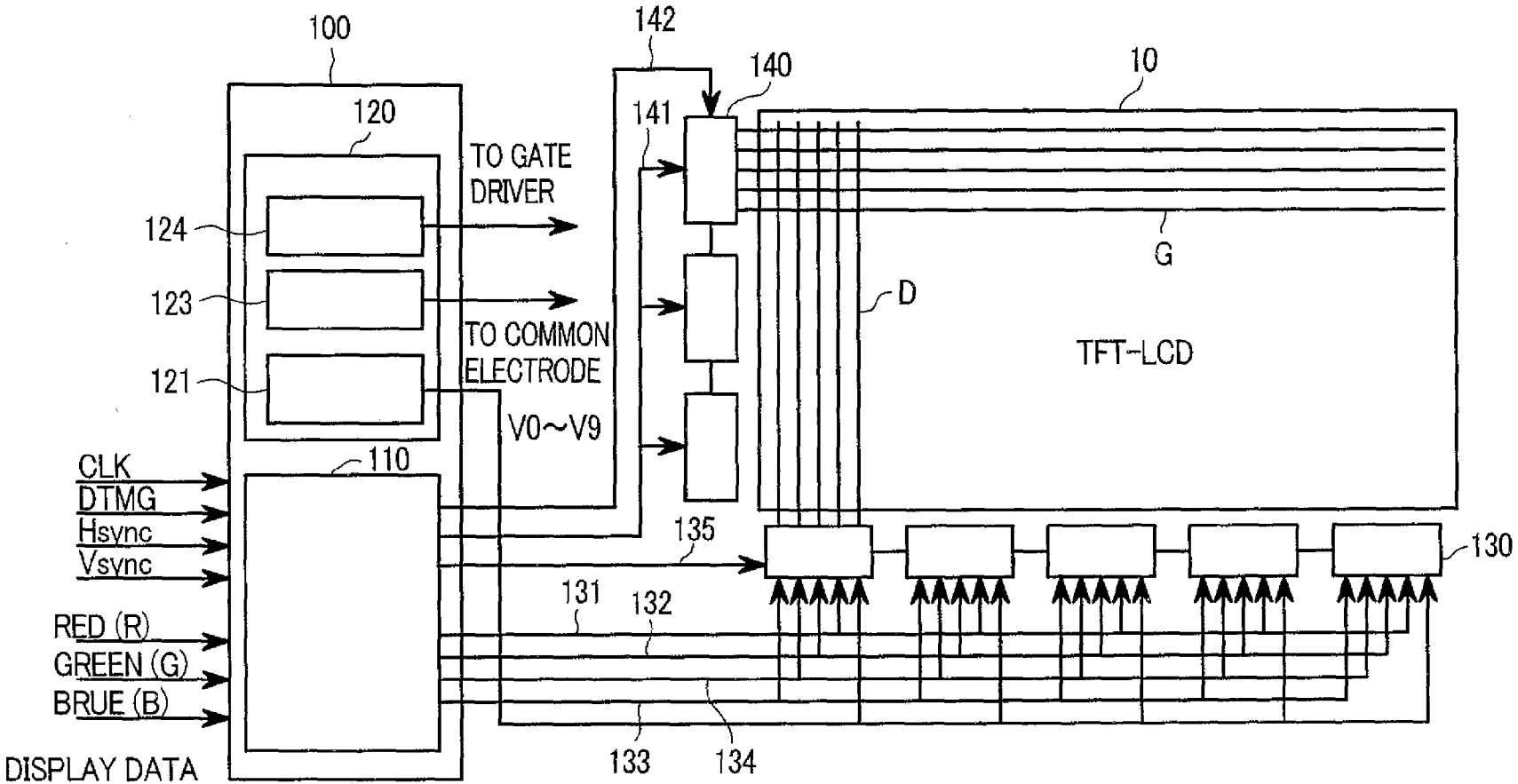
FIG. 1 is a block diagram showing the schematic construction of a TFT type of liquid crystal display module to which the invention is applied.

Preferred embodiments of the present invention will be described in detail with reference to the accompanying drawings. In all of the drawings which illustrate the preferred embodiments, parts having the same functions are denoted by the same reference numerals, and the repetitive descriptions of the same parts are omitted.

Embodiment 1

<Basic Construction of TFT Type of Liquid Crystal Display Module to which the Invention is Applied>

FIG. 1 is a block diagram showing the schematic construction of a TFT type of liquid crystal display module to which the invention is applied.

In the liquid crystal display module (LCM) shown in FIG. 1, drain drivers 130 are disposed along one longer side of a liquid crystal display panel (TFT-LCD) 10, while gate drivers 140 are disposed along one shorter side of the liquid crystal display panel 10. The drain drivers 130 and the gate drivers 140 are directly mounted on peripheral portions of one glass substrate (for example, a TFT substrate) of the liquid crystal display panel 10.

An interface part 100 is mounted on an interface board, and this interface board is mounted on the rear side of the liquid crystal display panel 10.

<Construction of Liquid Crystal Display Panel 10 Shown in FIG. 1>

Figure 2:
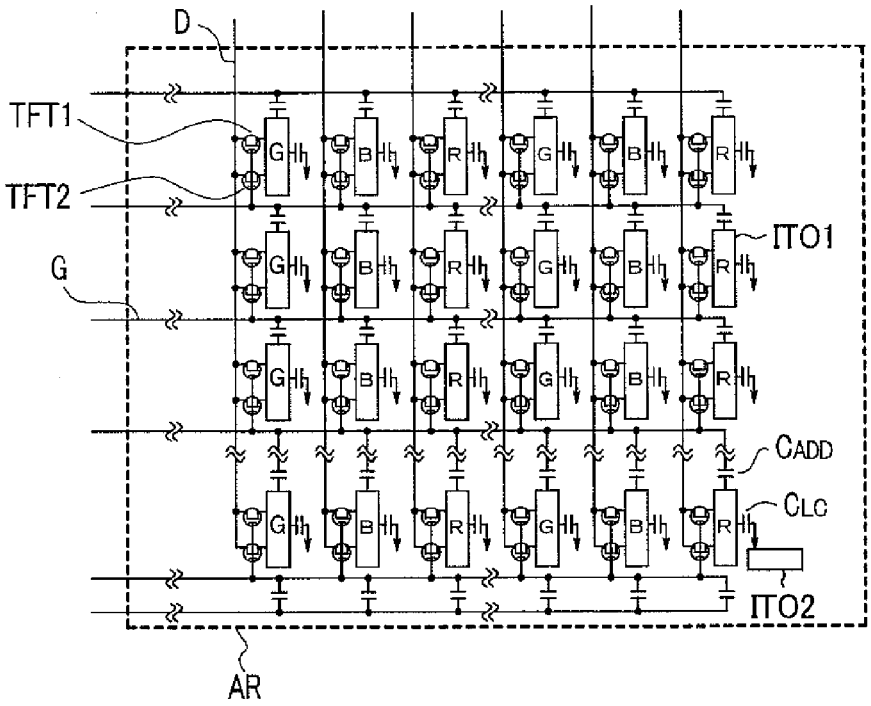
FIG. 2 is an equivalent circuit diagram of one example of the liquid crystal display panel shown in FIG. 1.

FIG. 2 is a view showing the equivalent circuit of one example of the liquid crystal display panel 10 shown in FIG. 1. As shown in FIG. 2, the liquid crystal display panel 10 has a plurality pixels, which are formed into a matrix array.

Each of the pixels is disposed in an area defined by the intersection of two adjacent signal lines (drain signal lines D or gate signal lines G) and two adjacent signal lines (gate signal lines G or drain signal lines D). Each of the pixels has thin film transistors TFT1 and TFT2, and the source electrodes of the thin film transistors TFT1 and TFT2 of each of the pixels are connected to a pixel electrode ITO1.

Since a liquid crystal layer is disposed between the pixel electrode ITO1 and a common electrode ITO2, a liquid crystal capacitance CLC is equivalently connected between the pixel electrode ITO1 and the common electrode ITO2. An additional capacitance CADD is connected between the source electrodes of the thin film transistors TFT1 and TFT2 and the front-stage of one of the two adjacent gate signal lines G.

Figure 3:
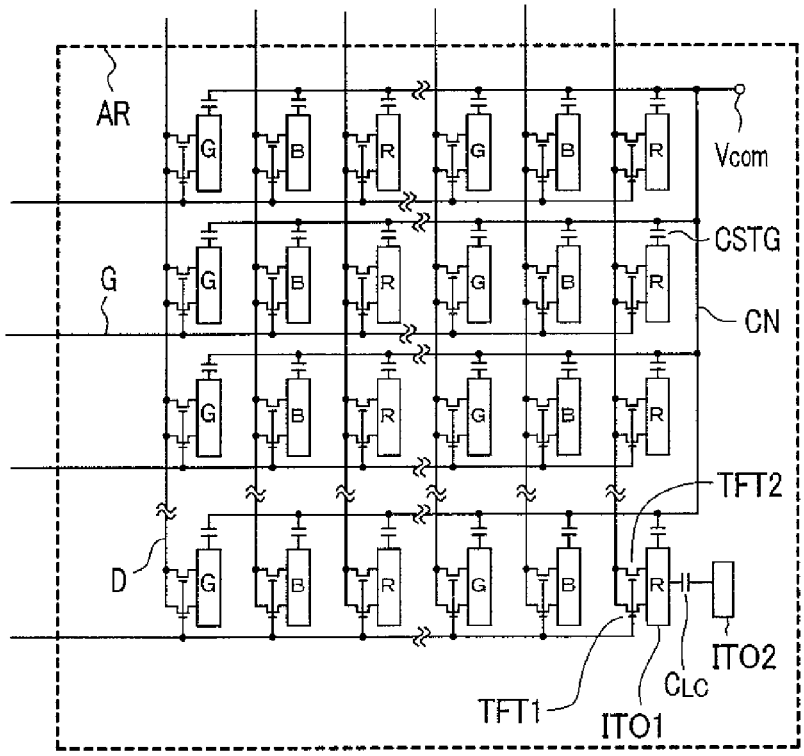
FIG. 3 is an equivalent circuit diagram of another example of the liquid crystal display panel shown in FIG. 1.

FIG. 3 is a diagram showing the equivalent circuit of another example of the liquid crystal display panel 10 shown in FIG. 1. In the example shown in FIG. 2, an additional capacitance CADD is formed between the front-stage gate signal line G and the source electrodes, whereas in the equivalent circuit of the example shown in FIG. 3, a charge-holding capacitance CSTG is formed between the source electrodes and a common signal line CN to which a common voltage Vcom is supplied. The invention is applicable to either of the examples.

Incidentally, FIGS. 2 and 3 show equivalent circuits of a vertical electric field type of liquid crystal display panel, and in each of FIGS. 2 and 3, the symbol AR denotes a display area. FIGS. 2 and 3 are also circuit diagrams which are drawn to correspond to the actual geometric arrangements of the elements.

In each of the liquid crystal display panels 10 shown in FIGS. 2 and 3, the drain electrodes of the respective thin film transistors TFT1 and TFT2 of each of the pixels, which are disposed in the column direction, are connected to the adjacent one of the drain signal lines D, and each of the drain signal lines D is connected to the corresponding one of the drain drivers 130, which apply gray scale voltages to the liquid crystals of the corresponding ones of the pixels disposed in the column direction.

The gate electrodes of the respective thin film transistors TFT1 and TFT2 of each of the pixels, which are disposed in the row direction, are connected to the adjacent one of the gate signal lines G, and each of the gate signal lines G is connected to a corresponding one of the gate drivers 140 which supplies, for one horizontal scanning period, scanning driving voltages (positive bias voltages or negative bias voltages) to the gate electrodes of the thin film transistors TFT1 and TFT2 of the corresponding ones of the pixels disposed in the row direction.

<Construction and Outline of Operation of Interface Part 100 Shown in FIG. 1>

The interface part 100 shown in FIG. 1 includes a display control device 110 and a power source circuit 120.

The display control device 110 is formed of a single semiconductor integrated circuit (LSI), and controls and drives the drain drivers 130 and the gate drivers 140 on the basis of display control signals, such as dot clock CLK, data enable signals (or display timing signals) DTMG, horizontal synchronizing signals Hsync and vertical synchronizing signals Vsync, as well as display data (R, G and B), all of which are to be transmitted from a computer host.

When the display control device 110 receives a data enable signal DTMG, the display control device 110 determines that this signal indicates a display start position, and outputs a data latching start pulse (or display data latching start signal) STH (hereinafter referred to as the start pulse STH) to the first one of the drain drivers 130 via a signal line 135, and, in addition, it outputs received display data for a single line to the drain drivers 130 via a bus line 133 for display data.

At this time, the display control device 110 outputs a data latching clock CL2 (hereinafter referred to as the clock CL2), for latching display data, to the data latching circuit of each of the drain drivers 130 via a signal line 131.

The display data from the host computer is transmitted as, for example, 6-bit data in units of one pixel, i.e., one set of red (R), green (G) and blue (B) data, at intervals of a unit time period.

In addition, the latching operation of the data latching circuit in the first drain driver 130 is controlled by the start pulse STH inputted to the first drain driver 130. When the latching operation of the data latching circuit in the first drain driver 130 is completed, the start pulse STH is inputted to the second drain driver 130 from the first drain driver 130, and the latching operation of the data latching circuit in the second drain driver 130 is controlled by the start pulse STH. Similarly, the latching operation of the data latching circuit in each of the following drain drivers 130 is controlled, whereby erroneous display data is prevented from being written into the data latching circuit.

When the inputting of the data enable signal DTMG is completed, or a predetermined time period passes after the data enable signal DTMG has been inputted, the display control device 110 determines that one horizontal line of display data has been completed, and outputs, to each of the drain drivers 130 via a signal line 132, an output timing control clock CL1 (hereinafter referred to simply as the drain output pulse CL1), which is a display control signal for outputting the display data stored in the data latching circuit of each of the drain drivers 130, to each of the drain signal lines D of the liquid crystal display panel 100.

When the first data enable signal DTMG is inputted to the display control device 110 after the inputting of a vertical synchronizing signal, the display control device 110 determines that this signal DTMG indicates the first display line, and it outputs a frame start pulse (or frame start indication signal) FLM to the gate drivers 140 via a signal line 142.

In addition, the display control device 110 outputs a data shift clock CL3, which is a shift clock having the cycle of one horizontal scanning period (hereinafter referred to as the clock CL3), to the gate drivers 140 via a signal line 141 so that a positive bias voltage is sequentially applied to each of the gate signal lines G of the liquid crystal display panel 10 at intervals of one horizontal scanning period on the basis of the horizontal synchronizing signal.

In this manner, a plurality of thin film transistors TFT which are connected to each of the gate signal lines G of the liquid crystal display panel 10, are held in 'their closed states for one horizontal synchronizing period.

By use of the above-described operation, an image is displayed on the liquid crystal display panel 10.

<Construction of Power Source Circuit 120 Shown in FIG. 1>

The power source circuit 120 shown in FIG. 1 is made up of a gray scale reference voltage generation circuit 121, a common electrode (counter electrode) voltage generation circuit 123 and a gate electrode voltage generation circuit 124.

The gray scale reference voltage generation circuit 121 is formed of a series resistance voltage dividing circuit, which outputs a ten-level gray scale reference voltage (V0 to V9). The gray scale reference voltage (V0 to V9) is supplied to each of the drain drivers 130.

In addition, an AC driving signal (AC driving timing signal; M) from the display control device 110 is supplied to each of the drain drivers 130 via the signal line 134.

The common electrode voltage generation circuit 123 generates a driving voltage to be applied to the common electrode ITO2, while the gate electrode voltage generation circuit 124 generates a driving voltage (a positive bias voltage and a negative bias voltage) to be applied to the gate electrodes of the thin film transistors TFT1 and TFT2.

<Construction of Drain Driver 130 Shown in FIG. 1>

Figure 4:
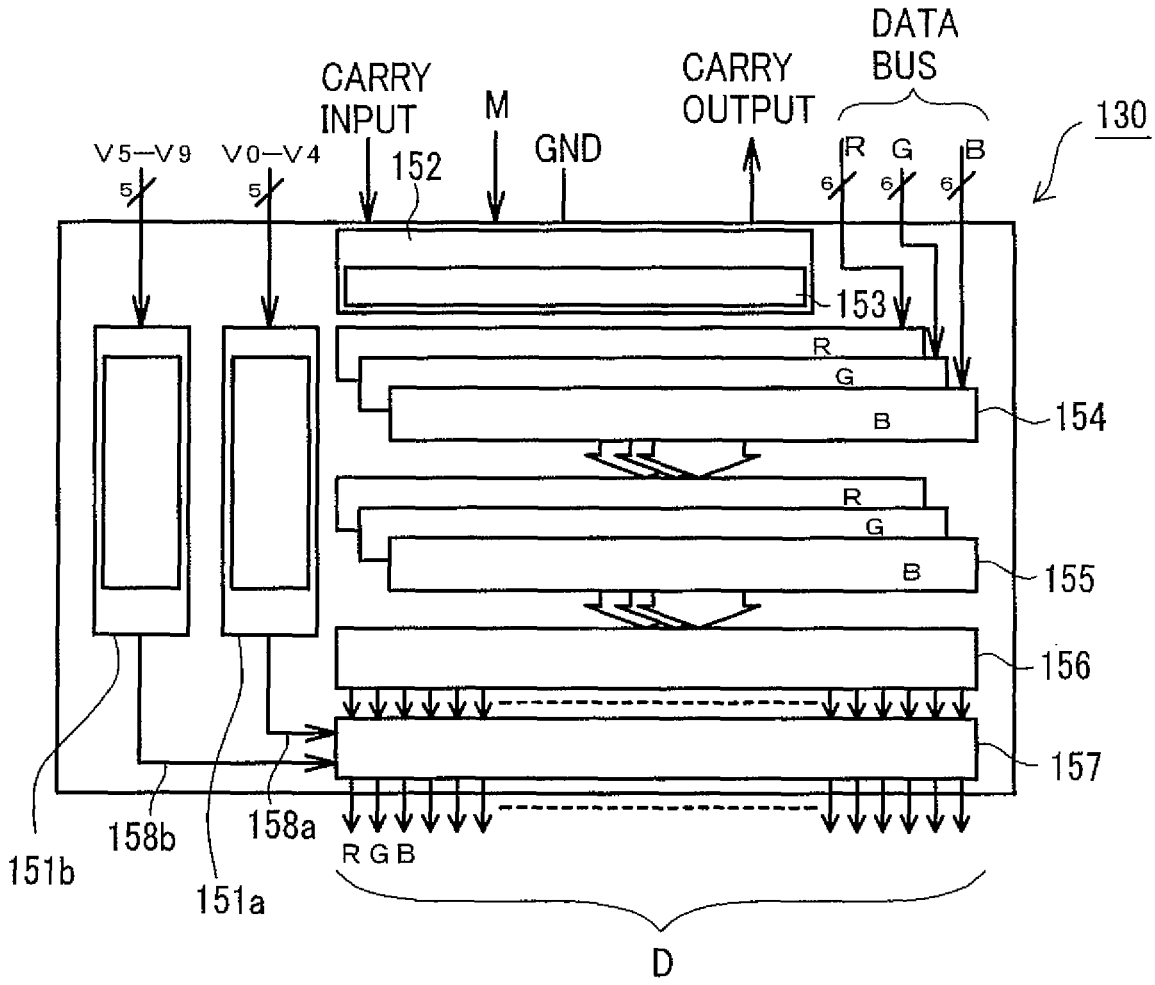
FIG. 4 is a block diagram showing a schematic construction of one example of the drain drivers shown in FIG. 1.

FIG. 4 is a block diagram showing a schematic construction of one example of the drain drivers 130 shown in FIG. 1. The drain driver 130 is made up of a single semiconductor integrated circuit (LSI).

In the circuit of FIG. 4, a positive gray scale voltage generation circuit 151*a* generates a 64-level gray scale voltage of positive polarity on the basis of the five-level gray scale reference voltage (V0 to V4) supplied from the gray scale reference voltage generation circuit 121, and it outputs the 64-level gray scale voltage to an output circuit 157 via a voltage bus line 158*a*.

A negative gray scale voltage generation circuit 151*b* generates a 64-level gray scale voltage of negative polarity on the basis of the five-level gray scale reference voltage (V5 to V9) of negative polarity supplied from the gray scale reference voltage generation circuit 121, and it outputs the 64-level gray scale voltage to the output circuit 157 via a voltage bus line 158*b*.

A shift register circuit 153 in a control circuit 152 of the drain driver 130 generates a data latching signal for an input register circuit 154, and it outputs the data latching signal to the input register circuit 154 on the basis of the clock signal CL2 inputted from the display control device 110.

The input register circuit 154 latches display data of 6 bits for each color by the number of output lines in synchronism with the clock signal CL2 inputted from the display control device 110, on the basis of the data latching signal outputted from the shift register circuit 153.

A storage register circuit 155 latches the display data stored in the input register circuit 154, in response to the clock CL1 inputted from the display control device 110.

The display data latched in the storage register circuit 155 is inputted to the output circuit 157 via a level shift circuit 156. The output circuit 157 selects one gray scale voltage level corresponding to the display data from the 64-level gray scale voltage of positive polarity or the 64-level gray scale voltage of negative polarity, and it outputs the selected one gray scale voltage level to each of the drain signal lines D.

<AC Driving Method of Liquid Crystal Display Module Shown in FIG. 1>

In general, if the same voltage (DC voltage) is continuously applied to a liquid crystal layer for a long time, the inclination of the liquid crystal layer becomes fixed, so that an image-retention phenomenon is caused, which tends to reduce the life of the liquid crystal layer. To prevent this problem, in a liquid crystal display module, a voltage to be applied to the liquid crystal layer is made to alternate at intervals of a constant time period i.e., a gray scale voltage to be applied to each of the pixel electrodes is made to vary between its positive voltage side and its negative voltage side at intervals of a constant time period with reference to a common voltage to be applied to its common electrodes (or counter electrodes).

As a driving method for applying an AC voltage to this liquid crystal layer, a common symmetry method and a common inversion method are known.

The common inversion method is a method which is characterized by alternately inverting both the common voltage to be applied to the common electrodes and the gray scale voltage to be applied to the pixel electrodes between their positive voltage sides and their negative voltage sides.

The common symmetry method is a method which is characterized by keeping constant the common voltage to be applied to the common electrodes and alternately inverting the gray scale voltage to be applied to the pixel electrodes between the positive voltage side and the negative voltage side with reference to the common voltage to be applied to the common electrodes.

Figure 5:
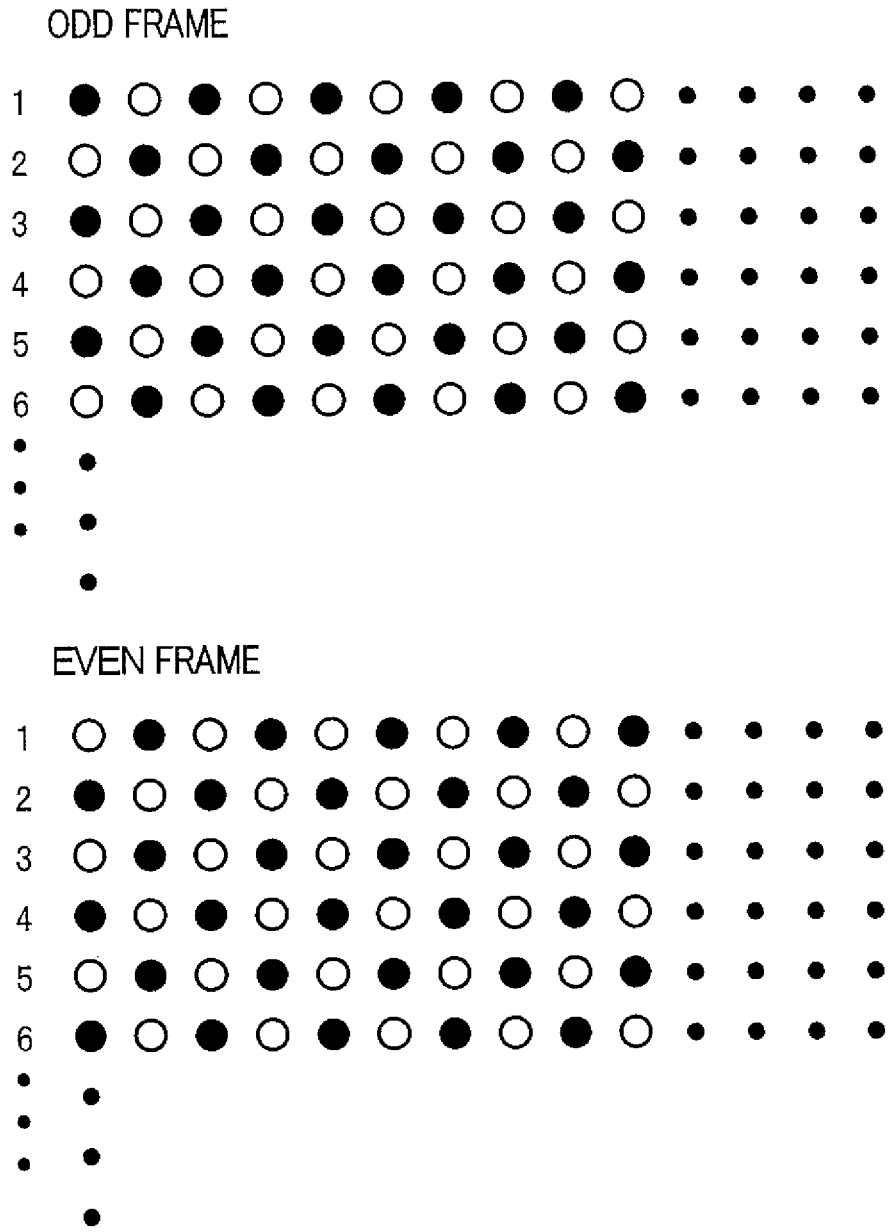
FIG. 5 is a diagram showing a case where a dot inversion method is used as a method of driving a liquid crystal display module, illustrating the polarities of gray scale voltages to be outputted from drain drivers to drain signal lines D.

FIG. 5 is a diagram showing a case where a dot inversion method is used as a method of driving a liquid crystal display module, illustrating the polarities of gray scale voltages to be outputted from its drain drivers to its drain signal lines (i.e., gray scale voltages to be applied to its pixel electrodes).

In the dot inversion method, as shown in FIG. 5 by way of example, in the odd lines of each odd frame, gray scale voltages of negative polarity (represented by "•" in FIG. 5), relative to a common voltage Vcom that is applied to the common electrodes, are applied to the odd-numbered ones of the drain signal lines from the drain drivers, while gray scale voltages of positive polarity (represented by "0" in FIG. 5) relative to the common voltage Vcom, that are applied to the common electrodes, are applied to the even-numbered ones of the drain signal lines from the drain drivers.

Furthermore, in the even lines of each odd frame, gray scale voltages of positive polarity are applied to the odd-numbered drain signal lines from the drain drivers, while gray scale voltages of negative polarity are applied to the even-numbered drain signal lines from the drain drivers.

In addition, the polarity of each of the lines is inverted from frame to frame, and, as shown in FIG. 5, in the odd lines of each even frame, gray scale voltages of positive polarity are applied to the odd-numbered drain signal lines from the drain drivers, while gray scale voltages of negative polarity are applied to the even-numbered drain signal lines from the drain drivers.

Furthermore, in the even lines of each even frame, gray scale voltages of negative polarity are applied to the odd-numbered drain signal lines from the drain drivers, while gray scale voltages of positive polarity are applied to the even-numbered drain signal lines from the drain drivers.

By using the above-described dot inversion method, the gray scale voltages applied to any adjacent ones of the drain signal lines become opposite to each other in polarity, and currents which flow through the common electrodes and the gate electrodes of the thin film transistors TFT cancel each other between mutually adjacent pixels, whereby the power consumption can be reduced.

In addition, since the currents flowing through the common electrodes are small and the voltage drops are not large, the voltage levels of the common electrodes are stable, whereby a decrease in display quality can be minimized.

<Timing Chart of Liquid Crystal Display Module Shown in FIG. 1>

As described above, the drain drivers 130 are controlled and driven by driving signals, such as the start pulse STH, the clock CL2, the drain output pulse CL1 and the AC driving signal M, all of which are transmitted from the display control device 110, and the gate drivers 140 are controlled and driven by the frame start pulse FLM and the clock CL3, which are transmitted from the display control device 110.

Figure 6:
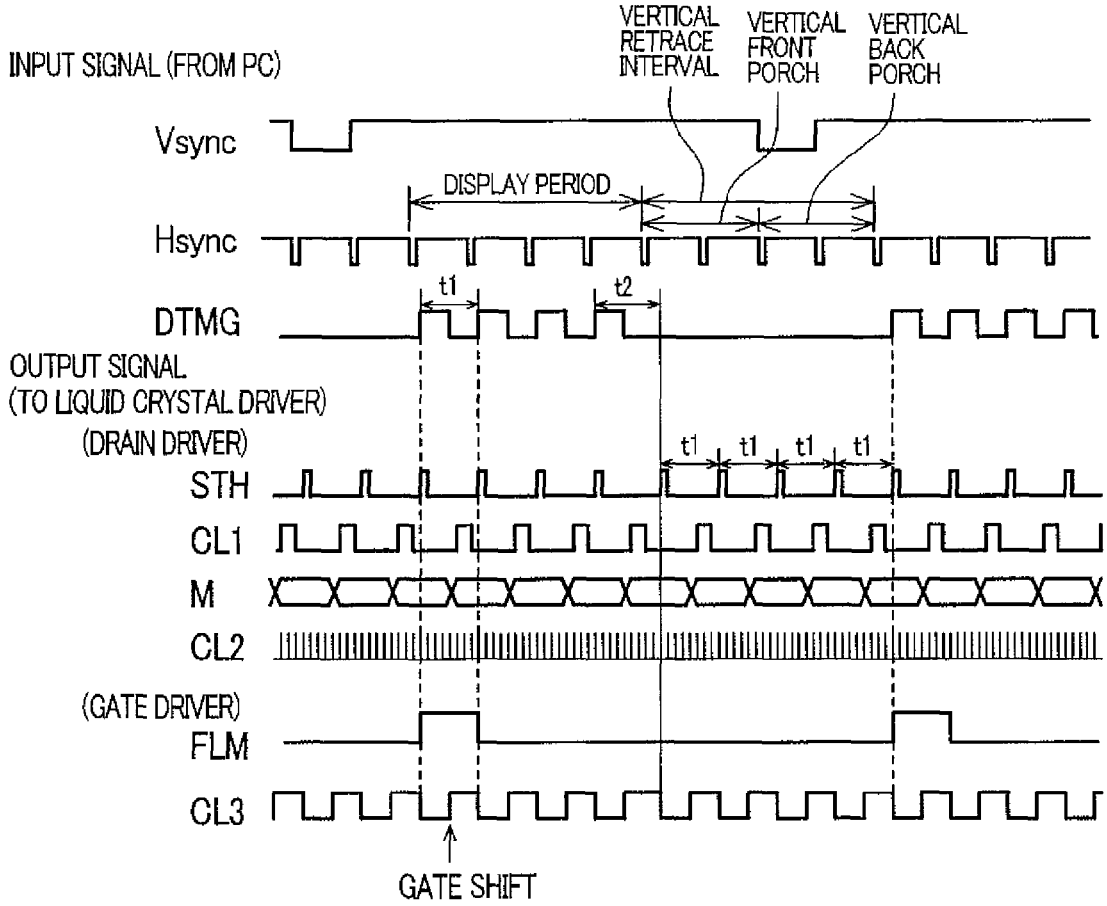
FIG. 6 is a timing chart showing one example in which the vertical retrace intervals do not vary at all or only slightly vary in the liquid crystal display module shown in FIG. 1.
Figure 6:
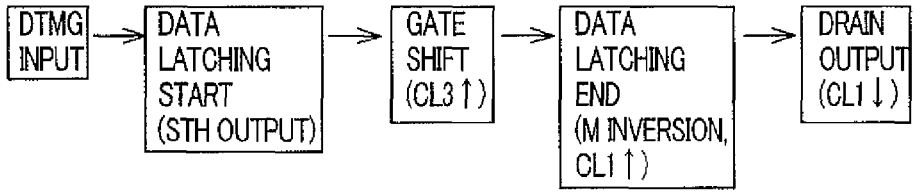

FIG. 6 is a diagram showing one example of a timing chart in which vertical retrace intervals do not vary at all or only slightly vary in the liquid crystal display module shown in FIG. 1.

The time period t1 shown in FIG. 6 is one horizontal cycle time (i.e., one horizontal scanning period), and when an image is to be displayed on the liquid crystal display panel 10, it is necessary, in general, to control the drain drivers 130 and the gate drivers 140 on the basis of a predetermined sequence within the time period t1 which starts in synchronism with the leading edge of the data enable signal DTMG, although control methods differ according to the specifications of the drivers.

One example of this sequence is shown in FIG. 6. In the sequence shown in FIG. 6, after the data enable signal DTMG has been inputted to the display control device 110, the display control device 110 transmits the start pulse STH and starts latching data in the drain drivers 130. Then, the display control device 110 sets the clock CL3 to a high level (hereinafter referred to simply as an H level), thereby shifting a horizontal line to be scanned to the next line of the gate signal line G and turning on the gate electrodes of the thin film transistors TFT1 and TFT2 along a horizontal line to be scanned.

After data has been latched in the drain drivers 130, the display control device 110 inverts the AC driving signal M and sets the drain output pulse CL1 to an M level. After that, the display control device 110 sets the drain output pulse CL1 to a low level (hereinafter referred to simply as an L level) and causes gray scale voltages of positive or negative polarity, corresponding to the display data to be outputted from the drain drivers 130 to the drain signal lines D.

In this sequence, as a matter of course, the pulse width, the period and the like of each of the signals must satisfy the specifications of the liquid crystal drivers.

If the above-described sequence is not satisfied, the expected visual display may not be obtained, or there is also a possibility that the liquid crystal drivers will be destroyed.

The time period t2 shown in FIG. 6 indicates the time (vertical retrace interval detection time) required to determine the vertical retrace interval. Although there are various methods for determining the vertical retrace interval, FIG. 6 shows an example in which, at the point of time when the input of a data enable signal DTMG is not received during the elapse of the time period t2 after the rise of the previous data enable signal DTMG, it is determined that a vertical retrace interval has started.

Within the vertical retrace interval, the output of gray scale voltages from the drain drivers 130 to the drain signal lines D is performed at a cycle of the time period t1 after the elapse of the time period t2. Incidentally, the above-described operation of outputting gray scale voltages from the drain drivers 130 to the drain signal lines D hereinafter will be referred to as "liquid crystal driving within a(the) vertical retrace interval".

Before this liquid crystal driving within the vertical retrace interval, gray scale voltages corresponding to the display data are written into the respective pixels along all of the lines of the liquid crystal display panel 10; for example, in the case of driving using a dot inversion method, the gray scale voltages of positive polarity or negative polarity shown in FIG. 5 are written.

Accordingly, during this liquid crystal driving within the vertical retrace interval, no gray scale voltages are written into the pixels; however, but for a reason which will be described later, gray scale voltages of an arbitrary level (generally, gray scale voltages for displaying white or black) are outputted from the drain drivers 130 to the drain signal lines D. Therefore, in the liquid crystal display module shown in FIG. 1, data for the liquid crystal driving within the vertical retrace interval is transmitted from the display control device 110 to the drain drivers 130 at least once.

In the sequence shown in FIG. 6, there is no contention between an output sequence for the last line during the liquid crystal driving within the vertical retrace interval and an output sequence activated by the input of a data enable signal DTMG for the next frame, so that the drain drivers 130 are prevented from malfunctioning or being destroyed.

However, if the vertical retrace interval varies, contention occurs between the output sequence for the last line during the liquid crystal driving within the vertical retrace interval and the output sequence activated by the input of the data enable signal DTMG for the next frame. For example, the periods of the synchronizing signals received by the liquid crystal display module are not always constant owing to enlargement/reduction processing for S.S. (Spread Spectrum), display data and the like in a host computer which serves as a signal source. In such a case, the vertical retrace interval varies.

Figure 7:
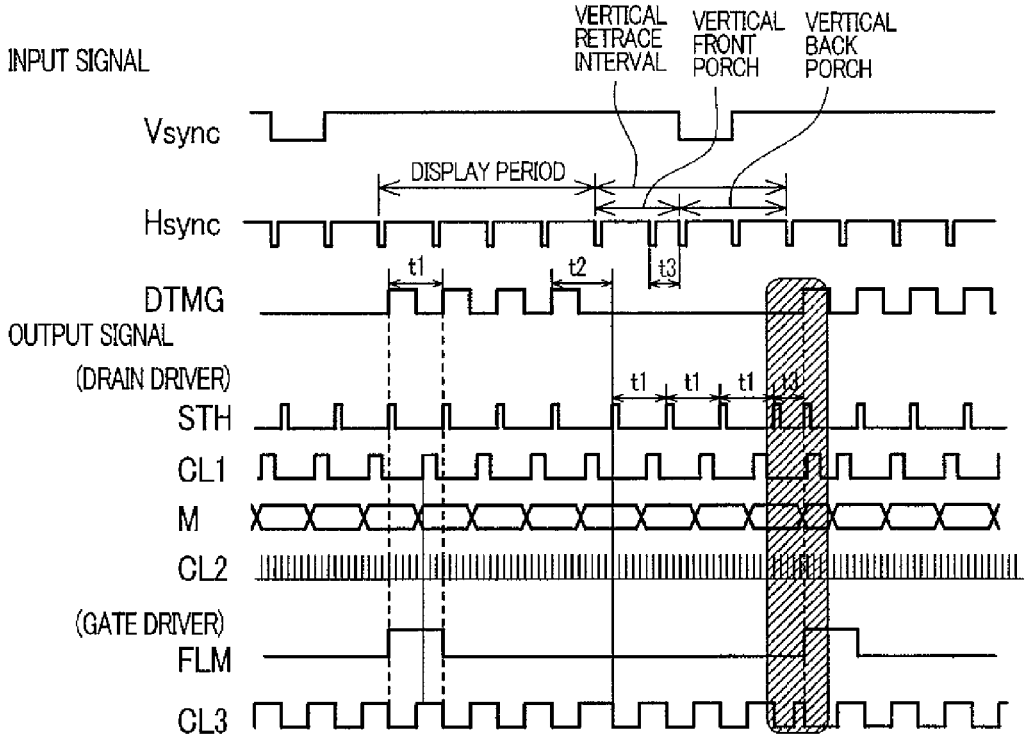
FIG. 7 is a timing chart in which the vertical retrace interval becomes short in the liquid crystal display module shown in FIG. 1.

FIG. 7 is a timing chart in which the vertical retrace interval becomes short in the liquid crystal display module shown in FIG. 1.

As a first example of a timing chart containing variations, FIG. 7 shows a case where, within the vertical retrace interval, the length of one horizontal synchronizing signal Hsync becomes equal to a time period t3, which is shorter than the time period t1 that represents one regular horizontal scanning cycle time period.

Referring to the cross-hatched portion in FIG. 7 (which represents the area in which contention occurs between the output sequences), a drain output pulse CL1 is not outputted within the time t3 with respect to a start pulse STH that has been outputted immediately before the data enable signal DTMG for the next frame, but is outputted with respect to a start pulse STH synchronized with the data enable signal DTMG for the next frame, so that two drain output pulses CL1 are outputted within the time period t1 and the pulse width of the clock CL3 becomes narrow. Accordingly, the sequence shown in FIG. 7 does not satisfy the sequence shown in FIG. 6 (the case where vertical retrace intervals do not vary at all or only slightly vary).

Figure 8:
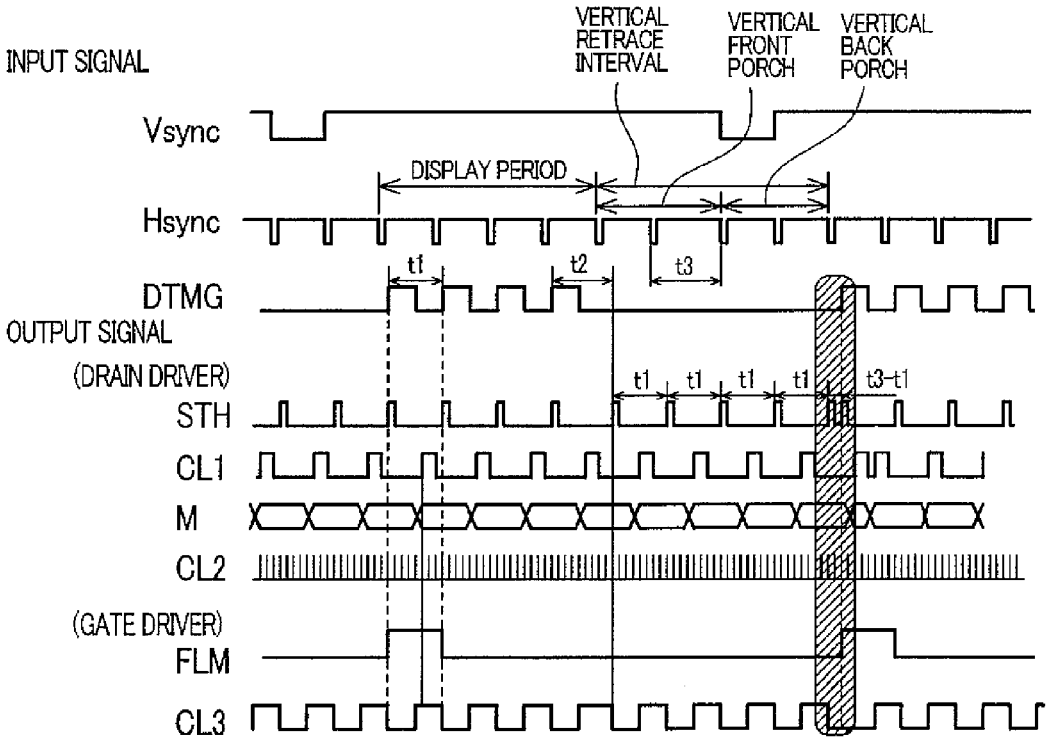
FIG. 8 is a timing chart in which the vertical retrace interval becomes long in the liquid crystal display module shown in FIG. 1.

FIG. 8 is a timing chart in which the vertical retrace interval becomes long in the liquid crystal display module shown in FIG. 1.

As a second example of a timing chart containing variations, FIG. 8 shows a case where, within the vertical retrace interval, the length of one horizontal synchronizing signal Hsync becomes equal to a time period t3, which is longer than the time period t1 that represents one regular horizontal scanning cycle time period.

Referring to a cross-hatched portion in FIG. 8 (which represents the area in which contention occurs between the output sequences), similar to the case of FIG. 7, a drain output pulse CL1 is not outputted within a time (t3-t1) with respect to a start pulse STH that is outputted immediately before the data enable signal DTMG for the next frame, but is outputted with respect to a start pulse STH synchronized with the data enable signal DTMG for the next frame, so that two drain output pulses CL1 are outputted within the time period t1. Thus, the sequence shown in FIG. 8 does not satisfy the sequence shown in FIG. 6 either.

In the case where the externally inputted signals follow a timing sequence such as that shown in FIG. 7 or 8, even if the output sequences are generated in accordance with one horizontal scanning cycle of a display period after it has been determined that a vertical retrace interval has started, expected visual display may not be obtained, or there is a possibility that liquid crystal drivers will be destroyed.

Figure 9:
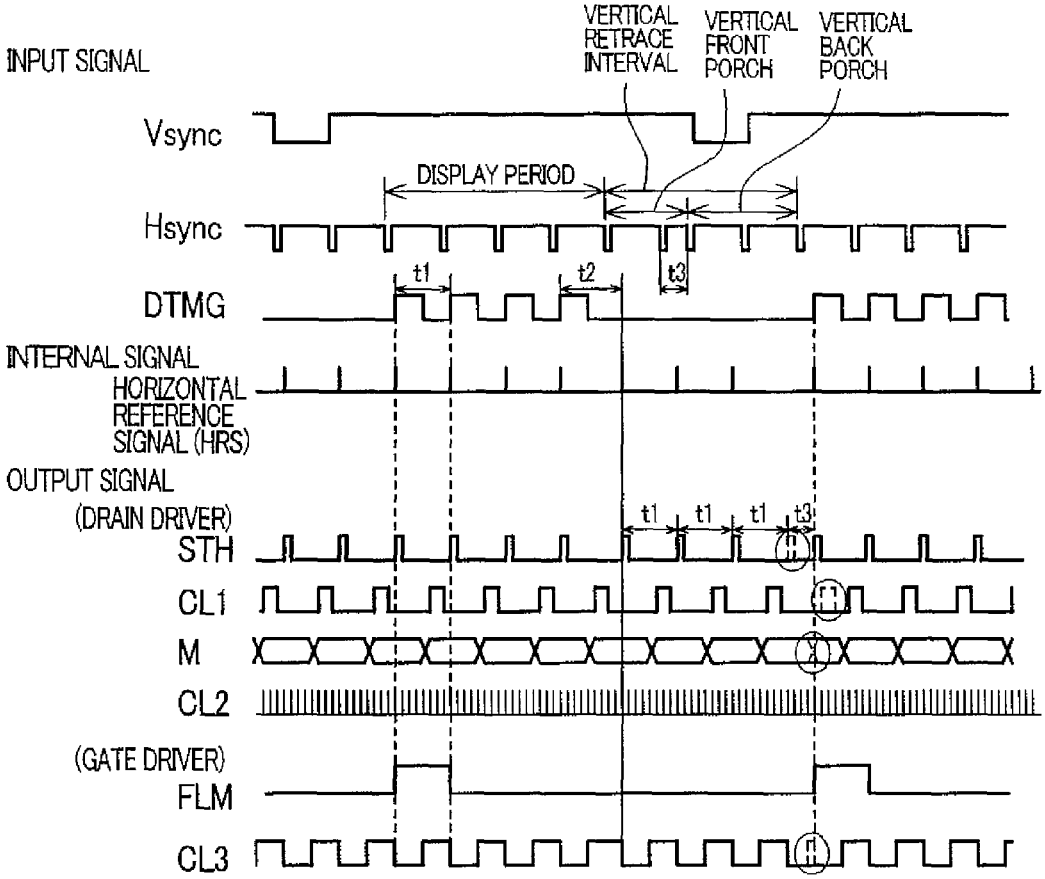
FIG. 9 is a timing chart showing one example of a liquid crystal display module according to Embodiment 1 of the invention.

Timing Chart of Liquid Crystal Display Module According to Embodiment 1 of the Invention FIG. 9 is a view showing one example of a timing chart of a liquid crystal display module according to Embodiment 1 of the invention.

In Embodiment 1, after a vertical retrace interval has started, the liquid crystal driving within the vertical retrace interval is stopped one or more lines before a data enable signal DTMG for the next frame is inputted.

FIG. 9 shows a timing chart in which the vertical retrace interval becomes short similar to the case of the timing chart shown in FIG. 7. In FIG. 9, the liquid crystal driving within the vertical retrace interval is stopped one line before a data enable signal DTMG for the next frame is inputted. To this end, in Embodiment 1, within the vertical retrace interval, the display control device 110 stops transmitting pulses (circled in FIG. 9) to the drain drivers 130 and the gate drivers 140, thereby stopping the liquid crystal driving within the vertical retrace interval.

Accordingly, in Embodiment 1, it is possible to perform the liquid crystal driving within the vertical retrace interval without any contention between the output sequence within the vertical retrace interval and the output sequence within the display period of the next frame after the completion of the vertical retrace interval.

The reason why the liquid crystal driving within the vertical retrace interval is performed will be described below.

Figure 10:
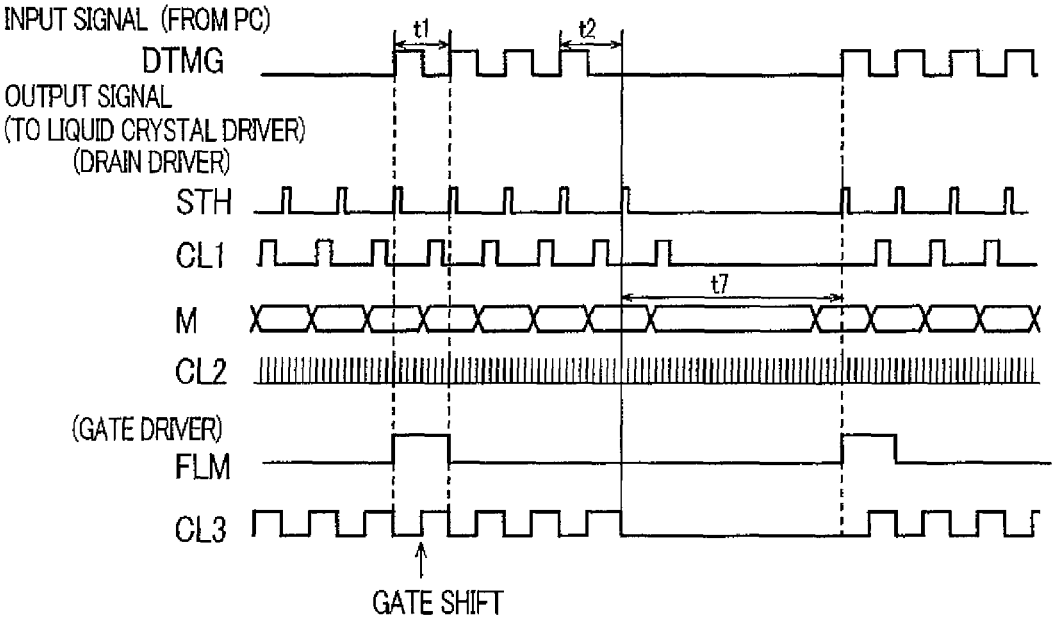
FIG. 10 is a timing chart in which, during the vertical retrace interval, liquid crystal driving for only one line is performed and AC driving is stopped until the input of the next frame.

FIG. 10 is a view showing a timing chart in which, during the vertical retrace interval, liquid crystal driving for only one line is performed and AC driving is stopped until the input of the next frame. In FIG. 10, symbol t7 denotes an interval during which AC driving is not being performed.

In the driving according to the timing chart shown in FIG. 10, there is a possibility that a defective visual display will be generated due to the length of the vertical retrace interval, the leakage characteristics of the thin film transistors TFT1 and TFT2 of each pixel, and the display data.

Figure 11:
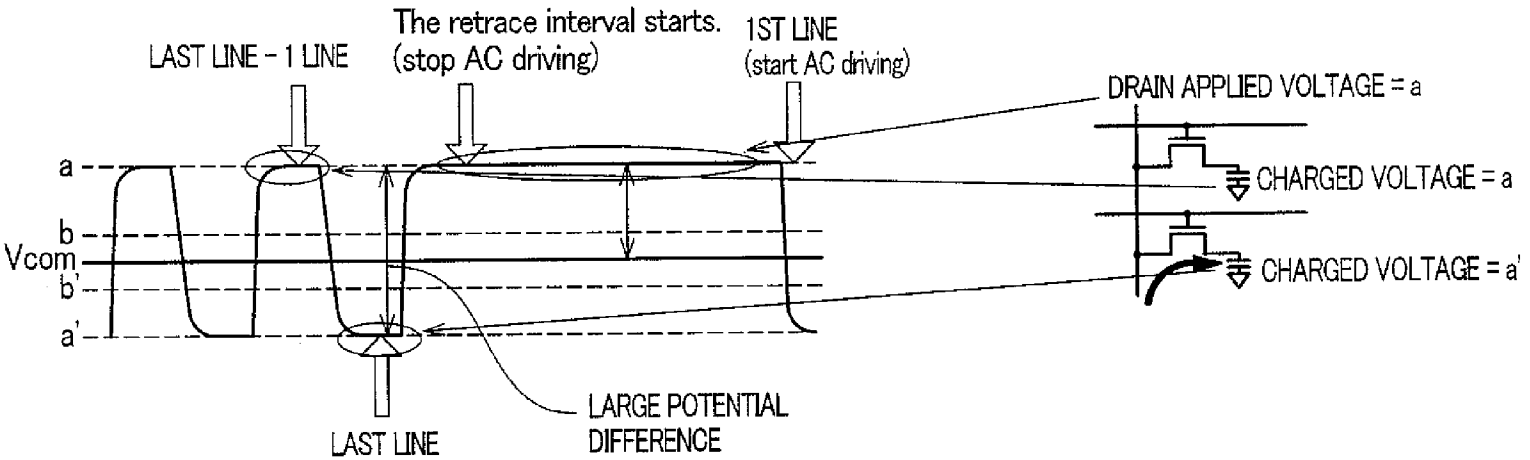
FIG. 11 is a diagram which illustrates the reason why a defective visual display occurs in the timing chart shown in FIG. 10.
Figure 12:
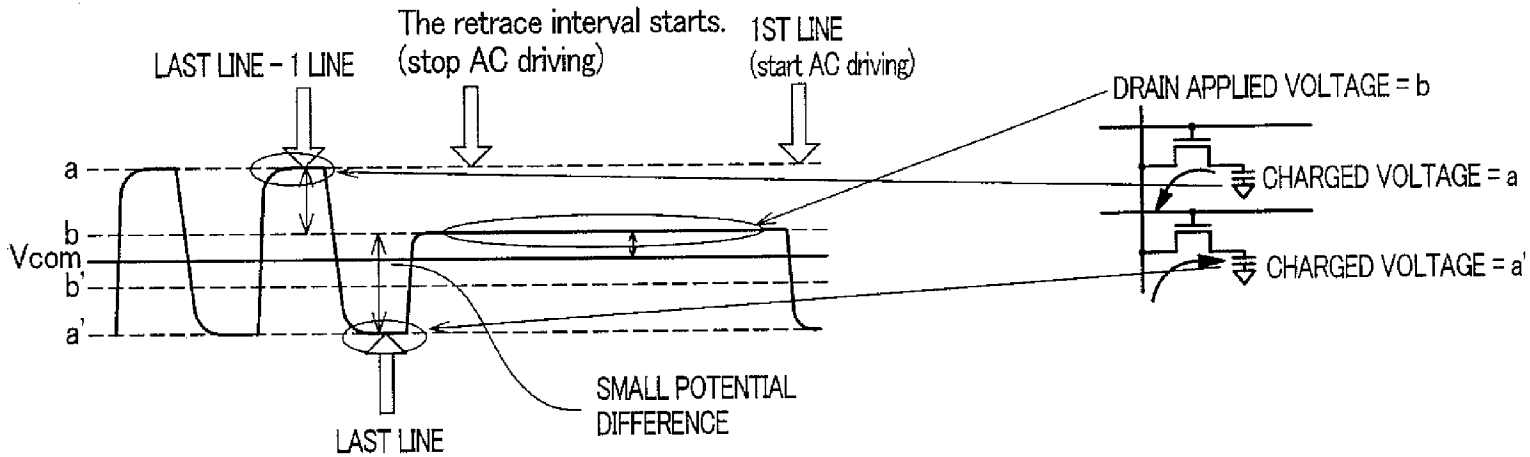
FIG. 12 is a diagram which illustrates the reason why a defective visual display occurs in the timing chart shown in FIG. 10.

FIGS. 11 and 12 will be referred to in explaining the reason why defective visual display occurs in the sequence according to the timing chart shown in FIG. 10. FIG. 11 illustrating the case where the display data represents a raster display whose amplitude is between a gray scale voltage "a" and a gray scale voltage "a", and this drawing shows the charge-holding characteristics of pixels with a gray scale voltage "a" applied to stop AC driving during the driving of the first line within a vertical retrace interval.

In this case, if the leakage characteristics of the thin film transistors TFT1 and TFT2 of the pixels are inferior, leakage currents occur in the pixels along the last line written (charged) with the gray scale voltage "a'", so that the voltage written in the pixels varies. In this case, since the gray scale voltage "a is written in the pixels along the second line from the last during the vertical retrace interval, even if the gray scale voltage "a" is applied to stop AC driving during the driving of the first line within the vertical retrace interval, the potential of the pixels and the potential of the drain signal lines D coincide with each other, and no leakage currents flow in the pixels along the last line. Accordingly, a luminance difference occurs between lines on the display screen, so that a lateral stripe occurs.

FIG. 12 illustrates the case where the display data represents a raster display whose amplitude is between the gray scale voltage "a" and the gray scale voltage "a'", and this drawing shows the charge-holding characteristics of the pixels with a gray scale voltage "b" applied to stop AC driving during the driving of the first line within a vertical retrace interval.

In this case, when the gray scale voltage "b" is finally applied, leakage currents occur in the pixels along the last line written with the gray scale voltage "a'" and the pixels along the second to the last line written with the gray scale voltage "a", so that lateral stripes occur. However, in the case shown in FIG. 12. the voltages written in the pixels on the adjacent lines vary owing to the leakage currents, and the potential difference between the voltage written in the pixels on one of the adjacent lines and the voltage written in the pixels on the other is smaller than the potential difference shown in FIG. 11, so that the lateral stripes are not very outstanding.

Figure 13:
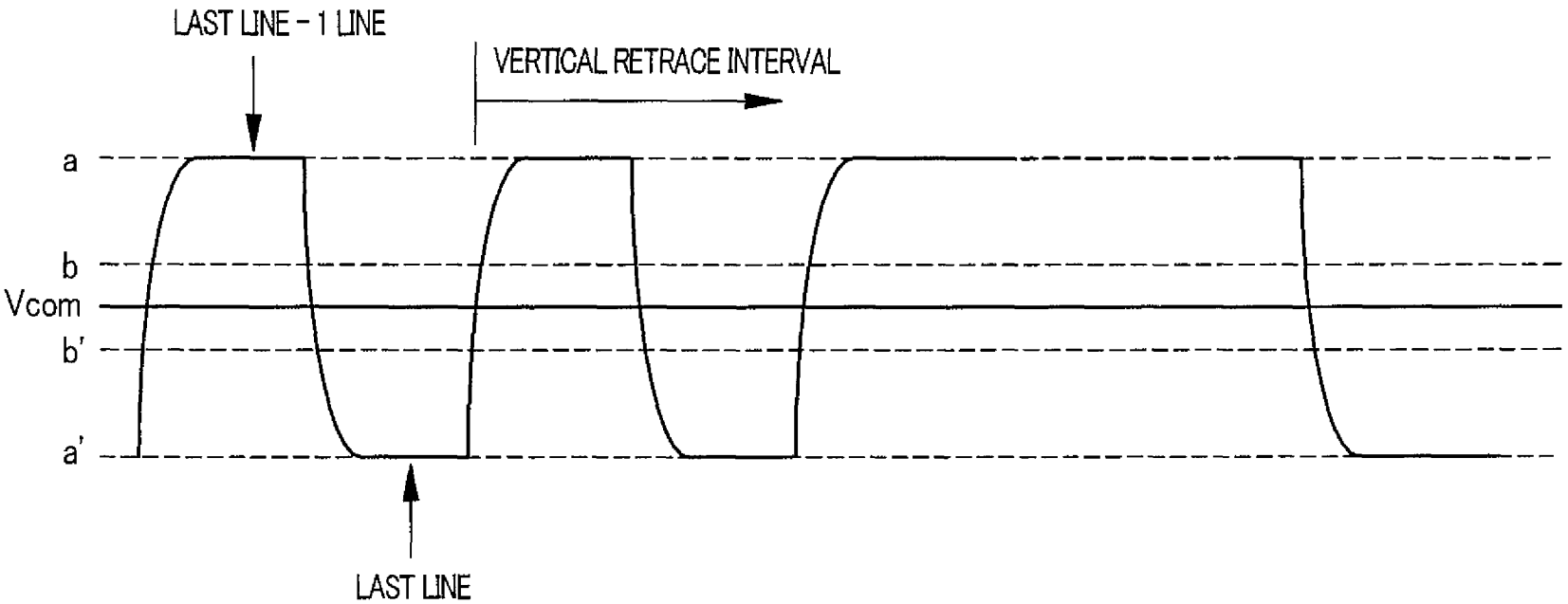
FIG. 13 is a diagram showing the charge-holding characteristics of pixels in the case where liquid crystal driving is performed on a plurality of lines during a vertical retrace interval.
Figure 14:
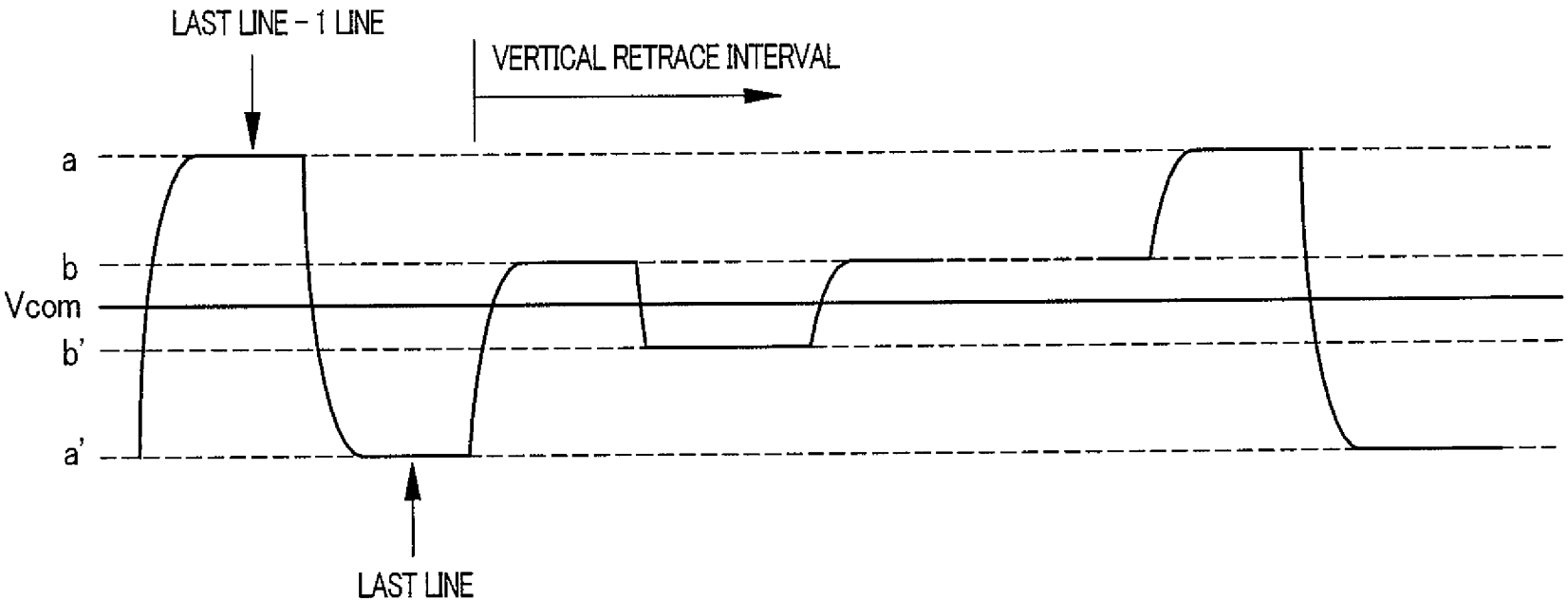
FIG. 14 is a diagram showing the charge-holding characteristics of pixels in the case where liquid crystal driving is performed on a plurality of lines during a vertical retrace interval.

FIGS. 13 and 14 are views showing the charge-holding characteristics of the pixels in the case where liquid crystal driving is performed on a plurality of lines within a vertical retrace interval.

Like FIG. 11, FIG. 13 shows the case where the display data represents a raster display whose amplitude is between the gray scale voltage "a" and the gray scale voltage "a'", and the gray scale voltage a and the gray scale voltage "a'" are alternately applied to the first and following lines within a vertical retrace interval to effect liquid crystal driving.

In this case, on the first line during the vertical retrace interval, similar to the case of FIG. 11, leakage currents to the pixels along the last line written with the gray scale voltage "a'" occur and the voltage written in the pixels will vary, and no leakage currents flow to the pixels along the second to the last line written with the gray scale voltage "a". However, on the second line during the vertical retrace interval, leakage currents to the pixels along the second to the last line written with the gray scale voltage "a" occur and the voltage written in the pixels will vary. In addition, in the pixels along the last line written with the gray scale voltage "a'", the amount of voltage variation on the first line is cancelled by the leakage currents, and the pixel voltages are written with the gray scale voltage "a'".

On the third line, for the above-described reason, the pixel voltage on the second to the last line written with the gray scale voltage "a" becomes the gray scale voltage "a". Accordingly, no luminance difference occurs between lines on the display screen, whereby it is possible to prevent the occurrence of lateral strips.

FIG. 14 shows the case where the display data represents a raster display whose amplitude is between the gray scale voltage "a" and the gray scale voltage "a'", similar to the display data shown in FIG. 12, and the gray scale voltage "b" and the gray scale voltage "b'" are alternately applied to the first and following lines within a vertical retrace interval to effect liquid crystal driving.

In this case, the pixel voltages of the pixels along the last line and the pixel voltages of the pixels along the second line from the last vary owing to line scanning during the vertical retrace interval, but the amounts of voltage variations on both lines are approximately the same. Accordingly, in the case of FIG. 14, the pixels along the last line and the pixels along the second line from the last vary similarly in luminance, whereby it is possible to prevent lateral stripes from occurring on the display screen.

As described above, in Embodiment 1, the voltages written in the pixels are prevented from being varied and causing lateral stripes to be generated on the display screen, whereby it is possible to improve the display quality of the display screen.

Incidentally, in Embodiment 1, letting M be a value obtained by dividing the vertical retrace interval by a regular horizontal scanning time and rounding up fractions to the nearest whole number, and letting N be an integer not smaller than one, the liquid crystal driving within the vertical retrace interval is preferably performed on not smaller than two lines and not greater than (M-N) times, more preferably not smaller than M/2 times and not greater than (M-N) times.

Incidentally, the value M is also a value obtained by adding together the number of lines scanned during the whole of the vertical retrace interval and the number of lines scanned during at least a part of the vertical retrace interval, in the case where scanning is performed with the regular horizontal scanning time within the vertical retrace interval.

The value of N is preferably N=1 or N=2 in view of the necessity to drive as many lines as possible, but the invention is not limited to such a value. AC driving is desirably performed at least once, preferably by a predetermined number of times, so that the period of AC driving becomes approximately the same as the display period.

In addition, the gray scale voltage applied during the liquid crystal driving within the vertical retrace interval is preferably a gray scale voltage corresponding to white or black.

Embodiment 2

Unique Construction of Liquid Crystal Display Module According to Embodiment 2

In Embodiment 2, to realize a timing chart sequence such as that shown in FIG. 9, the display control device 110 generates a horizontal reference signal and driving signals for liquid crystal drivers on the basis of the horizontal reference signal, and it masks in advance a horizontal reference signal, between which and the driving signals for liquid crystal drivers, contention may occur.

Figure 15:
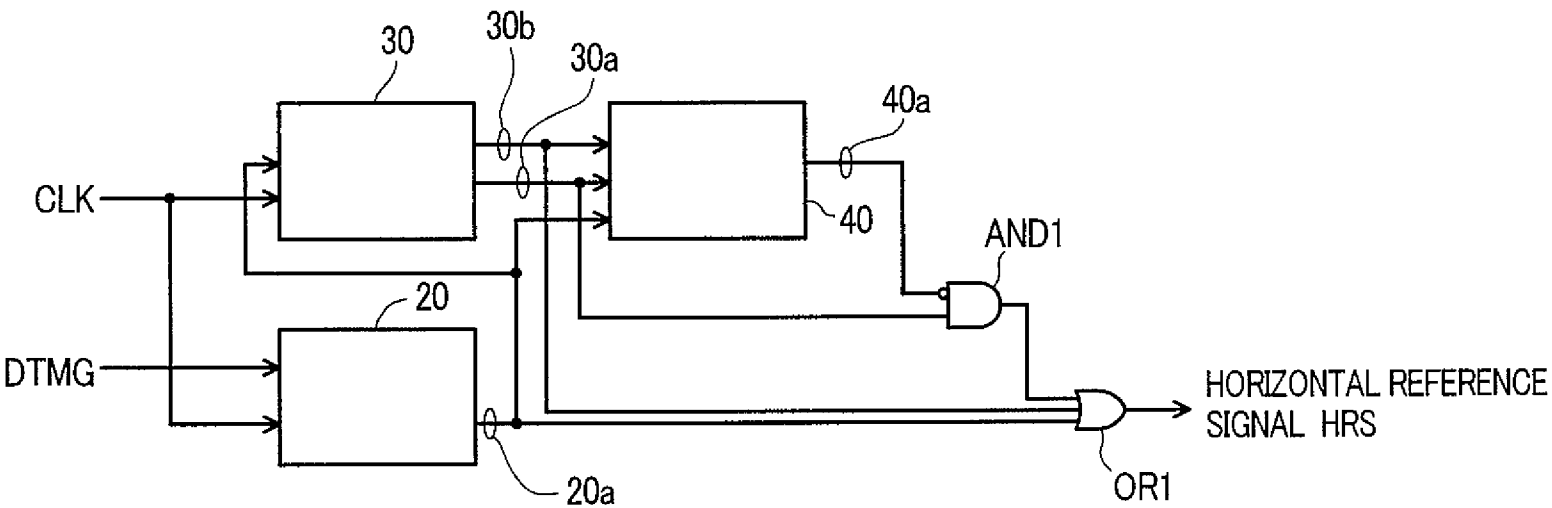
FIG. 15 is a block diagram showing the construction of a horizontal reference signal generation part of Embodiment 2 of the invention.

FIG. 15 is a block diagram showing the construction of a horizontal reference signal generation part of Embodiment 2 of the invention.

The horizontal reference signal generation part of Embodiment 2 is made up of a within-display-period horizontal reference signal generation circuit 20, a within-retrace-interval horizontal reference signal generation circuit 30, and a horizontal-reference-signal masking signal generation circuit 40. The horizontal reference signal generation part also has an AND circuit AND1 and an OR circuit OR1.

The within-display-period horizontal reference signal generation circuit 20, in response to a data enable signal DTMG, generates a horizontal reference signal for generating driving signals for driving liquid crystal drivers within a display period (a within-display-period horizontal reference signal 20*a*).

The within-retrace-interval horizontal reference signal generation circuit 30 detects a vertical retrace interval, and it subsequently generates a horizontal reference signal for generating driving signals for driving liquid crystal drivers within the detected vertical retrace interval (a within-retrace-interval horizontal reference signal 30*a*). The within-retrace-interval horizontal reference signal generation circuit 30 also generates a vertical retrace interval indication signal 30*b*.

The horizontal-reference-signal masking signal generation circuit 40 counts the number of lines within a vertical retrace interval and generates a signal for masking horizontal reference signals within the vertical retrace interval for an arbitrary number of lines (a within-retrace-interval horizontal reference masking signal 40*a*). The horizontal reference signal generation part finally generates a horizontal reference signal HR on the basis of these signals.

As described above, the driving signals for liquid crystal drivers are the start pulse STH, the clock CL2, the drain output pulse CL1 and the AC driving signal M all of which are transmitted from the display control device 110 to the drain drivers 130, as well as the frame start pulse FLM and the clock CL3, which are transmitted from the display control device 110 to the gate drivers 140.

Figure 16:
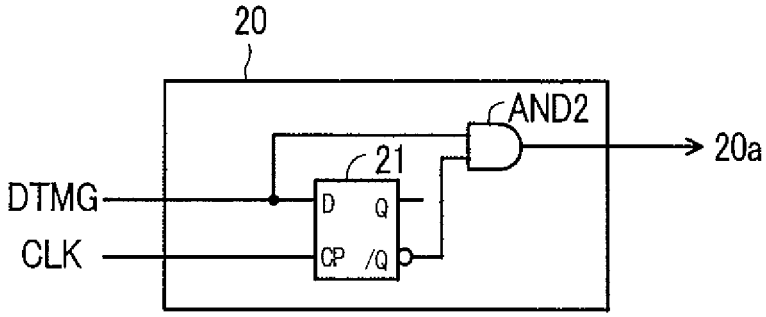
FIG. 16 is a circuit diagram showing the circuit construction of the within-display-period horizontal reference signal generation circuit shown in FIG. 15.
Figure 17:
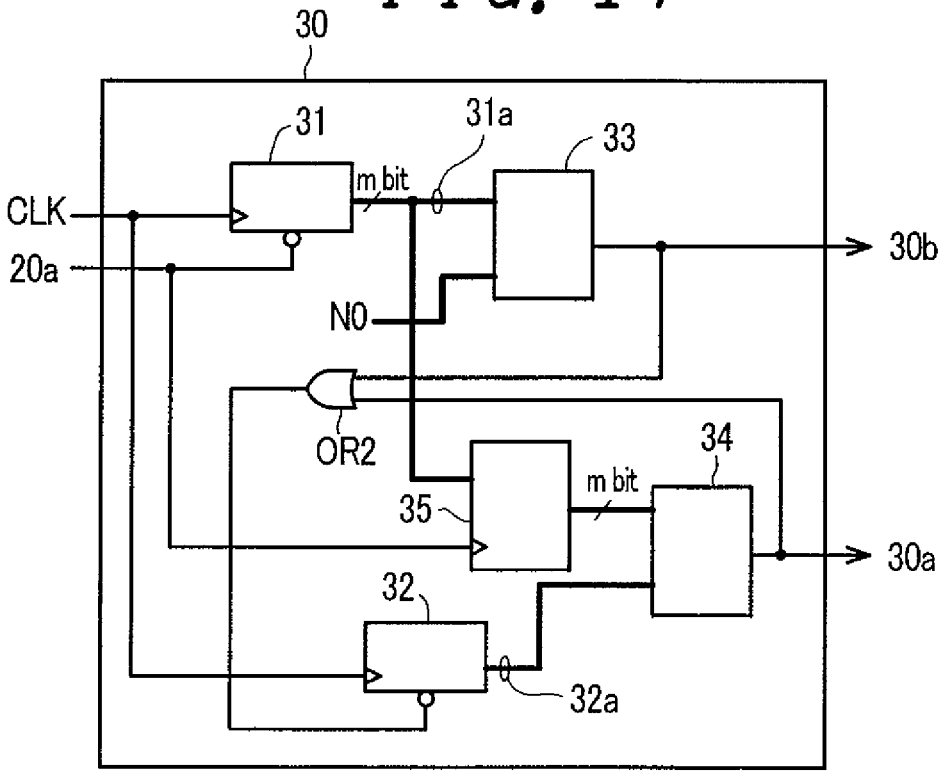
FIG. 17 is a circuit diagram showing the circuit construction of the within-retrace-interval horizontal reference signal generation circuit shown in FIG. 15.
Figure 18:
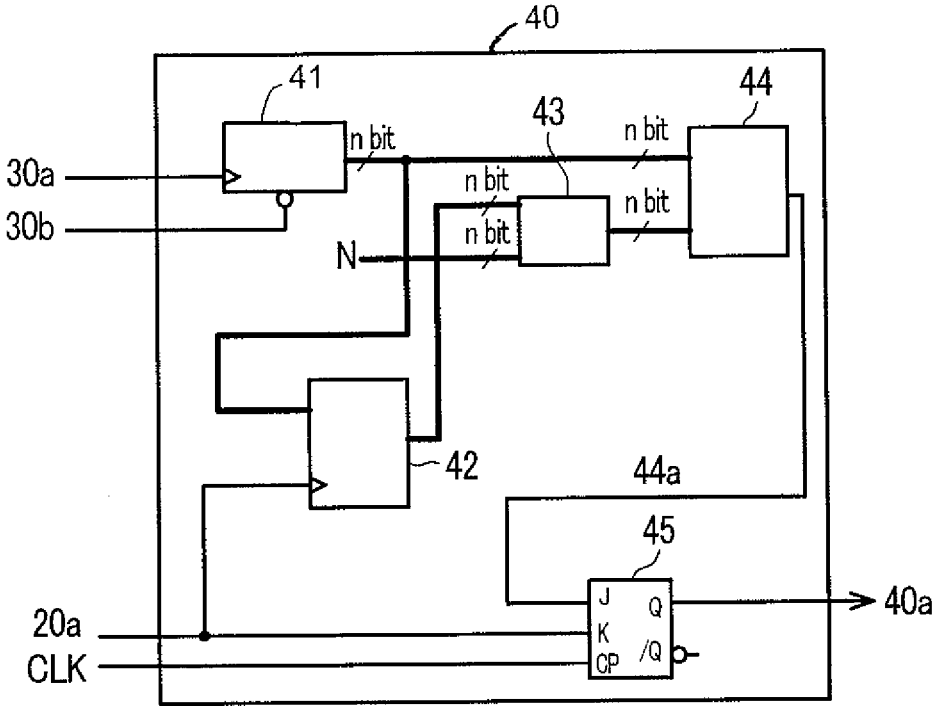
FIG. 18 is a circuit diagram showing the circuit construction of the horizontal-reference-signal masking signal generation circuit shown in FIG. 15.
Figure 19:
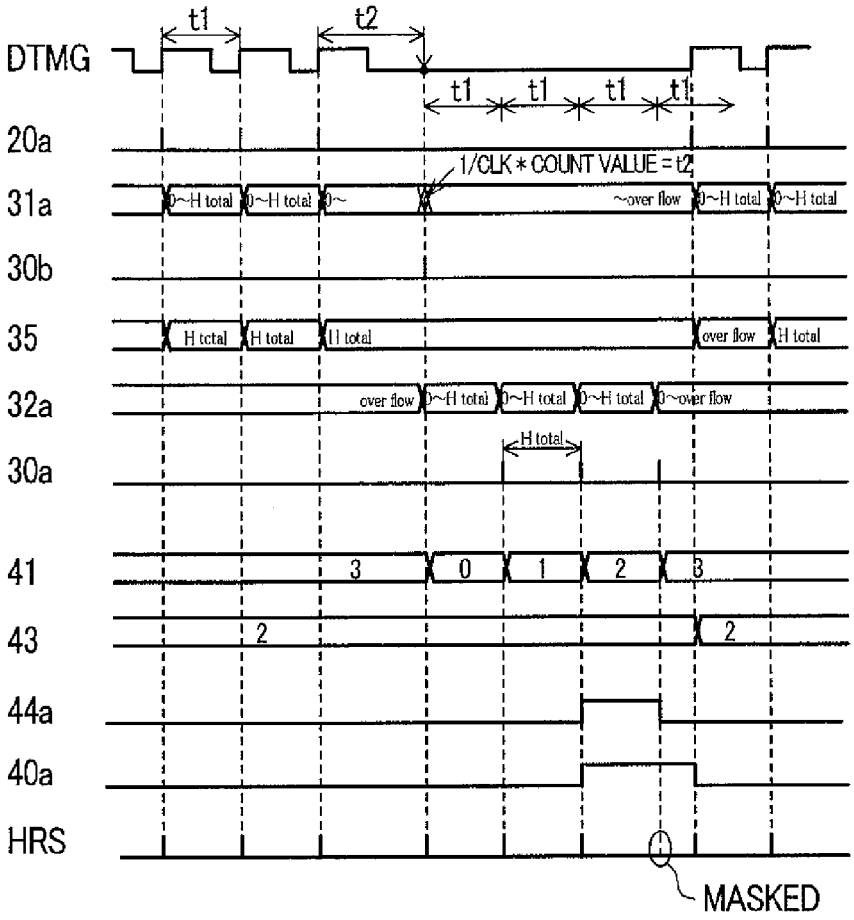
FIG. 19 is a timing chart of main signals generated by the circuits shown in FIGS. 16 to 18.

FIG. 16 is a circuit diagram showing the circuit construction of the within-display-period horizontal reference signal generation circuit 20 shown in FIG. 15. FIG. 17 is a circuit diagram showing the circuit construction of the within-retrace-interval horizontal reference signal generation circuit 30 shown in FIG. 15. FIG. 18 is a circuit diagram showing the circuit construction of the horizontal-reference-signal masking signal generation circuit 40 shown in FIG. 15. FIG. 19 is a timing chart of main signals generated by the circuits shown in FIGS. 16 to 18.

The circuits shown in FIGS. 16 to 18 will be described below.

The within-display-period horizontal reference signal generation circuit 20, shown in FIG. 16, includes a D flip-flop circuit 21 having an input terminal D to which the data enable signal DTMG is inputted and a clock input terminal CP to which the clock signal CLK is inputted. An AND circuit AND2 carries out a logical AND operation between the output from the output terminal /Q of the D flip-flop circuit 21 and the data enable signal DTMG, and it generates the within-display-period horizontal reference signal 20*a*, which is synchronized with the rise of the data enable signal DTMG and has one dot clock width of the clock signal CLK, as shown in FIG. 19.

In the within-retrace-interval horizontal reference signal generation circuit 30 shown in FIG. 17, an Htotal counter_1 (hereinafter referred to simply as the counter_1) 31 counts dot clocks CLK and is reset by the within-display-period horizontal reference signal 20*a*. A count value 31*a* of the counter_1 31 is stored in an Htotal hold register (hereinafter referred to simply as a hold register) 35 by the within-display-period horizontal reference signal 20*a*. Namely, the count value 31*a* stored in the hold register 35 is the number of dot clocks CLK per period of the within-display-period horizontal reference signal 20*a*, and it indicates one horizontal scanning time within a display period.

As shown in FIG. 19, when the data enable signal DTMG is not inputted, the within-display-period horizontal reference signal 20*a* is not generated, whereby the counter_1 31 counts the dot clocks CLK without being reset by the within-display-period horizontal reference signal 20*a*. The count value of the counter_1 31 is inputted to a comparator_1 33; and, when the count value reaches a count value of N0, the comparator_1 33 outputs the vertical retrace interval indication signal 30*b* shown in FIG. 19.

As shown in FIG. 15, the vertical retrace interval indication signal 30*b* is inputted to the OR circuit OR1, and the OR circuit OR1 outputs a first within-vertical-retrace-interval horizontal reference signal HRS, as also shown in FIG. 19.

Incidentally, letting 1/CLK be one period of the dot clock CLK, N0 is selected to satisfy (1/CLK)×N0=t2. Namely, even if the count value of the counter_1 31 exceeds a predetermined time period (t2 in FIG. 19), the comparator_1 33 detects that the inputting of the data enable signal DTMG is not being performed, and detects the occurrence of a vertical retrace interval.

In this case, since the within-display-period horizontal reference signal 20*a* is not inputted to the hold register 35, the count value stored in the hold register 35 becomes a count value latched by the previous within-display-period horizontal reference signal 20*a* (i.e., a count value indicative of one horizontal scanning time within a display period).

The vertical retrace interval indication signal 30*b* outputted from the comparator_1 33 is also inputted to the OR circuit OR2, and the OR circuit OR2 goes to its H level. At this time, an Htotal counter_2 (hereinafter referred to simply as the counter_2) 32 is reset, and the counter_2 32 counts the dot clocks CLK. A count value 32*a* of the counter_2 32 is inputted to a comparator_2 34; and, when the count value of the counter_2 32 coincides with the count value stored in the hold register 35, the comparator_2 34 outputs the within-retrace-interval horizontal reference signal 30*a*.

Since the within-retrace-interval horizontal reference signal 30*a* outputted from the comparator_2 34 is inputted to the OR circuit OR2, the counter_2 32 is reset, and the counter_2 32 again starts to count the dot clocks CLK. Accordingly, as shown in FIG. 19, the comparator_2 34 outputs the within-retrace-interval horizontal reference signal 30*a* at intervals of the time period t1.

In the horizontal-reference-signal masking signal generation circuit 40 shown in FIG. 18, a retrace line counter 41 is reset by the vertical retrace interval indication signal 30*b* outputted from the comparator_1 33 shown in FIG. 17, and it counts the within-retrace-interval horizontal reference signal 30*a* outputted from the comparator_2 34 shown in FIG. 17. Namely, the retrace line counter 41 counts the total number of lines within a vertical retrace interval. Incidentally, the total number of lines is the number of lines obtained when each line whose scanning time is less than one horizontal scanning time is also counted as one line. In Embodiment 2, since the value of the retrace line counter 41 starts with "0", a value smaller by one than an actual total number of lines is displayed.

A retrace line hold register (hereinafter referred to simply as the line register) 42 stores the count value of the retrace line counter 41 in response to the within-display-period horizontal reference signal 20*a*. Namely, the total number of lines within the vertical retrace interval of the previous frame is stored in the line register 42. The count value stored in the line register 42 is inputted to a subtracter 43, and, in the subtracter 43, the number of lines to be masked, N, is subtracted from the count value.

The output from the subtracter 43 is inputted to a comparator_3 44, and the outputted value is compared with the count value outputted from the retrace line counter 41. For example, if the number of lines stored in the line register 42 is three and the number of lines to be masked, N, is one, as shown in FIG. 19, when the count value outputted from the retrace line counter 41 becomes 2 (=3−1), the comparator_3 44 outputs a masking start signal, as shown in FIG. 19.

This masking start signal is inputted to a terminal j of a J-K flip-flop circuit 45; and, at this time, since the within-display-period horizontal reference signal 20*a* is not being inputted to a terminal K thereof, the J-K flip-flop circuit 45 outputs the within-retrace-interval horizontal reference masking signal 40*a* from its terminal Q, as shown in FIG. 19. The within-retrace-interval horizontal reference masking signal 40*a* goes to its L level when the within-display-period horizontal reference signal 20*a* for the next frame is inputted to the terminal K of the J-K flip-flop circuit 45, as shown in FIG. 19.

The inverted signal of the within-retrace-interval horizontal reference masking signal 40*a* is inputted to the AND circuit AND1 shown in FIG. 15, so that the within-retrace-interval horizontal reference signal 30*a* within the H-level period of the within-retrace-interval horizontal reference masking signal 40*a* is masked by the AND circuit AND1, as shown in FIG. 19.

As shown in FIG. 15, the within-display-period horizontal reference signal 20*a* outputted from the within-display-period horizontal reference signal generation circuit 20, the vertical retrace interval indication signal 30*b* outputted from the within-retrace-interval horizontal reference signal generation circuit 30 (this signal is also used as one kind of within-retrace-interval horizontal reference signal), and the within-retrace-interval horizontal reference signal 30*a* outputted through the AND circuit AND1, after having been outputted from the within-retrace-interval horizontal reference signal generation circuit 30, are inputted to the OR circuit OR1, and the OR circuit OR1 outputs the horizontal reference signal HRS for generating driving signals for liquid crystal drivers which do not come into contention.

Accordingly, in Embodiment 2, it is possible to perform the liquid crystal driving within the vertical retrace interval without any contention between the output sequence within the vertical retrace interval and the output sequence within the display period of the next frame after the completion of the vertical retrace interval.

Incidentally, the horizontal reference signal generation part shown in FIG. 15 is provided in the display control device 110, and this horizontal reference signal generation part uses only the data enable signal DTMG and the dot clock CLK. For this reason, in Embodiment 2, the vertical synchronizing signal Vsync and the horizontal synchronizing signal Hsync are not needed as display control signals to be inputted externally.

Embodiment 3

Unique Construction of Liquid Crystal Display Module According to Embodiment 3

In Embodiment 3 as well, to realize a timing chart such as that shown in FIG. 9, the display control device 110 generates a horizontal reference signal and generates driving signals for the liquid crystal drivers on the basis of the horizontal reference signal, and it masks in advance a horizontal reference signal, between which and the driving signals for liquid crystal drivers, contention may occur. However, in Embodiment 3, the data enable signal DTMG, the dot clock CLK and the horizontal synchronizing signal Hsync are used.

Figure 20:
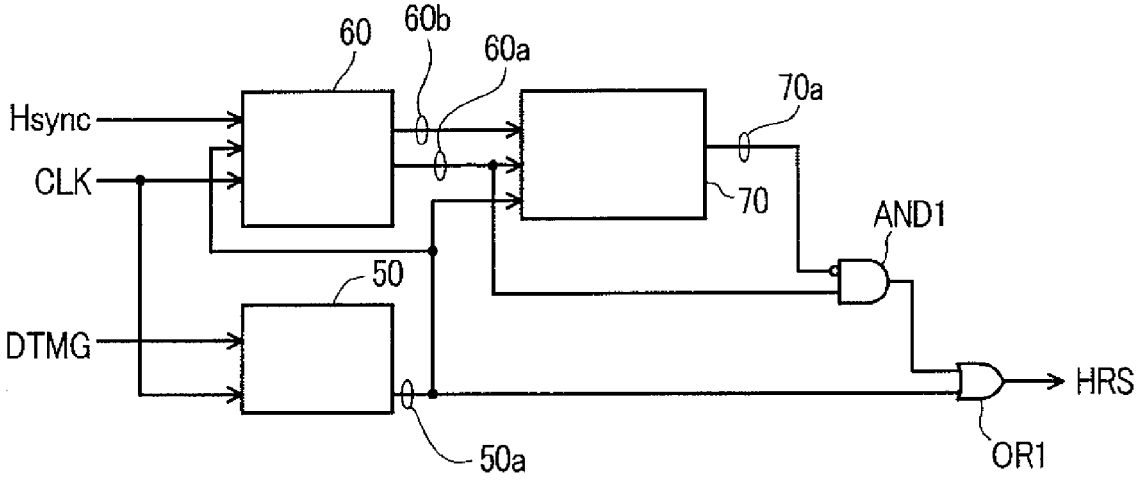
FIG. 20 is a block diagram showing the construction of a horizontal reference signal generation part of Embodiment 3 of the invention.

FIG. 20 is a block diagram showing the construction of a horizontal reference signal generation part of Embodiment 3 of the invention.

The horizontal reference signal generation part of Embodiment 3 is made of a within-display-period horizontal reference signal generation circuit 50, a within-retrace-interval horizontal reference signal generation circuit 60, and a horizontal-reference-signal masking signal generation circuit 70. The horizontal reference signal generation part also has an AND circuit AND1 and OR circuit OR1.

However, the horizontal reference signal generation part of Embodiment 3 differs from the horizontal reference signal generation part of Embodiment 2 in that a vertical retrace interval indication signal 60*b*, that is outputted from the within-retrace-interval horizontal reference signal generation circuit 60, is not inputted to the OR circuit OR1.

Figure 21:
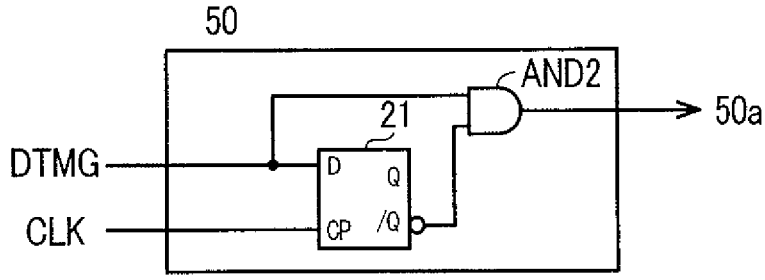
FIG. 21 is a circuit diagram showing the circuit construction of the within-display-period horizontal reference signal generation circuit shown in FIG. 20.
Figure 22:
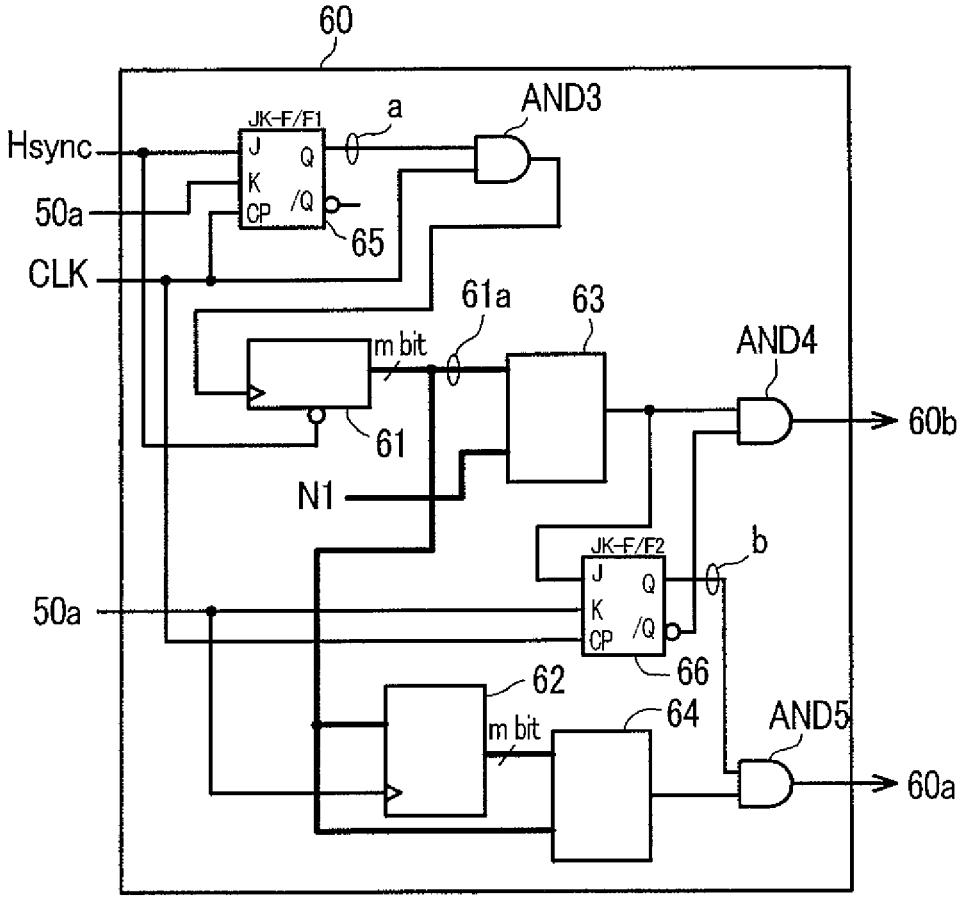
FIG. 22 is a circuit diagram showing the circuit construction of the within-retrace-interval horizontal reference signal generation circuit shown in FIG. 20.
Figure 23:
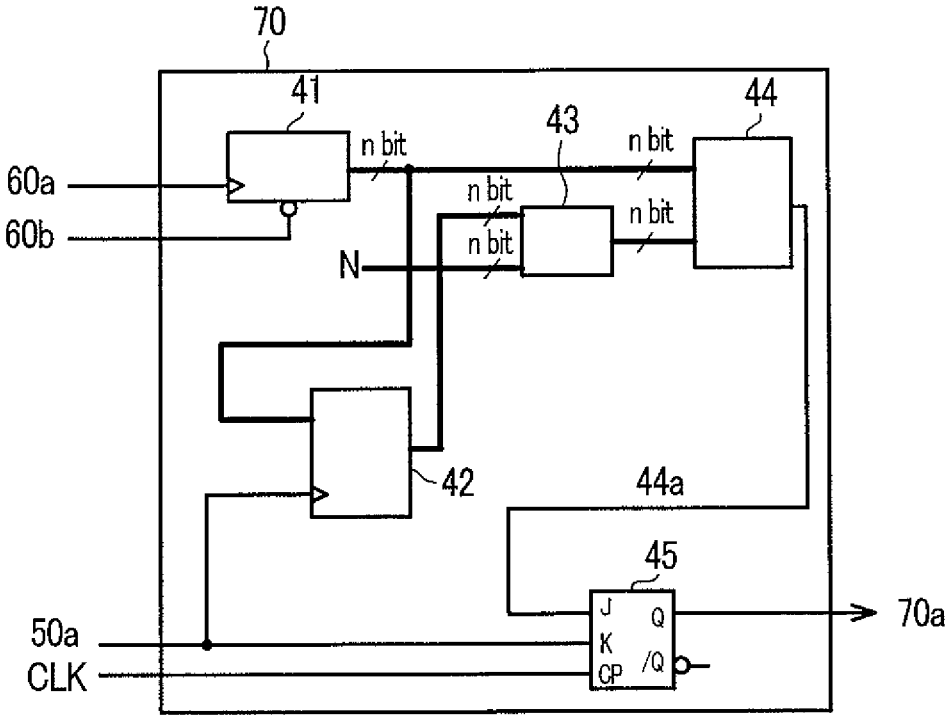
FIG. 23 is a circuit diagram showing the circuit construction of the horizontal-reference-signal masking signal generation circuit shown in FIG. 20.
Figure 24:
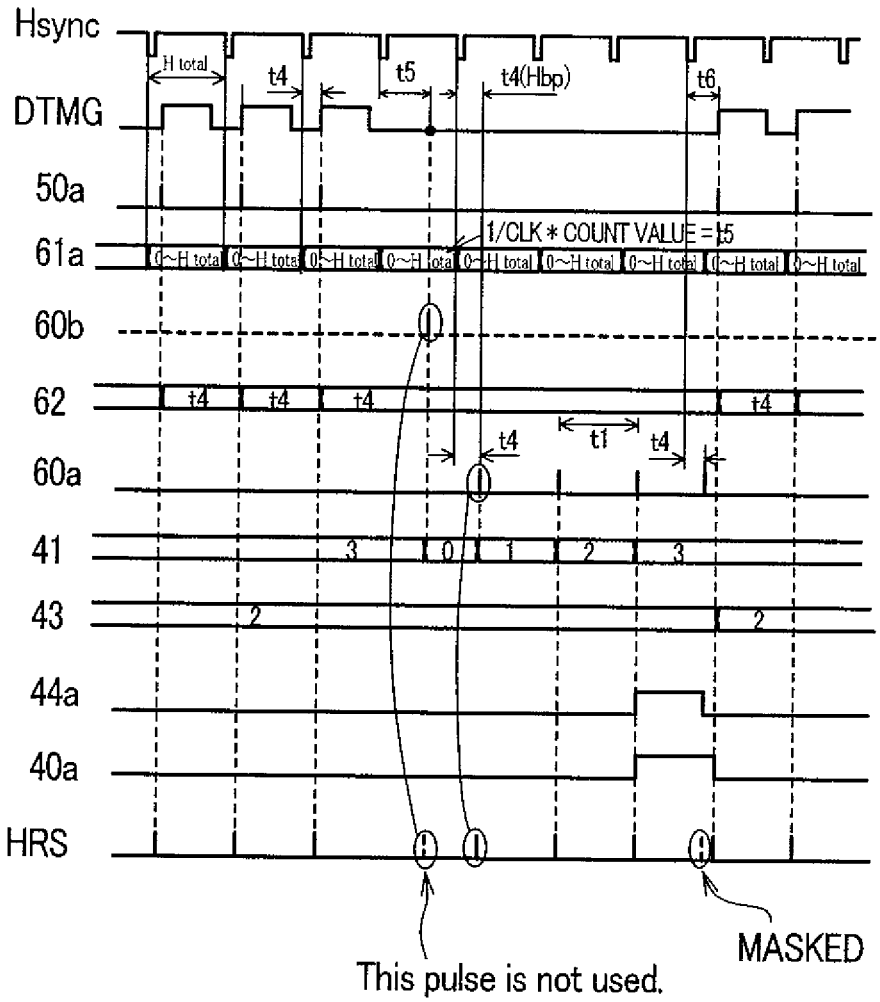
FIG. 24 is a timing chart of main signals generated by the circuits shown in FIGS. 21 to 23.
Figure 25:
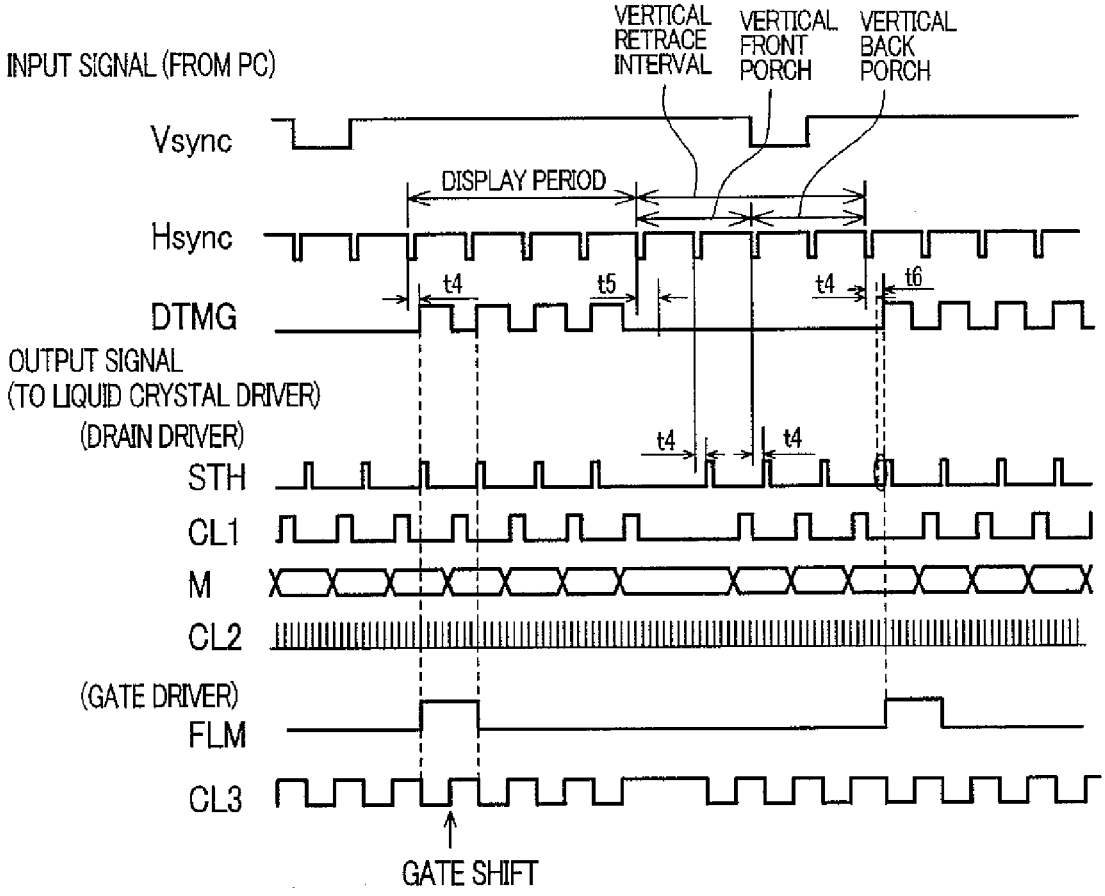
FIG. 25 is a timing chart of signals of a liquid crystal display module of Embodiment 3 of the invention.

FIG. 21 is a circuit diagram showing the circuit construction of the within-display-period horizontal reference signal generation circuit 50 shown in FIG. 20. FIG. 22 is a circuit diagram showing the circuit construction of the within-retract-interval horizontal reference signal generation circuit 60 shown in FIG. 20. FIG. 23 is a circuit diagram showing the circuit construction of the horizontal-reference-signal masking signal generation circuit 70 shown in FIG. 20. FIG. 24 is a view showing a timing chart of main signals generated by the circuits shown in FIGS. 21 to 23. FIG. 25 is a timing chart of the liquid crystal display module of Embodiment 3.

The reason why the vertical retrace interval indication signal 60*b* is not inputted to the OR circuit OR1 is as follows: Referring to FIG. 24, as described above, there is a likelihood that if the vertical retrace interval indication signal 60*b* is used as a within-retrace-interval horizontal reference signal 60*a*, the vertical retrace interval indication signal 60*b* will come into contention with the next within-retrace-interval horizontal reference signal 60*a* generated by the within-retrace-interval horizontal reference signal generation circuit 60.

The within-display-period horizontal reference signal generation circuit 50 shown in FIG. 21 is the same as the within-display-period horizontal reference signal generation circuit 20 shown in FIG. 16, and so a detailed description of the within-display-period horizontal reference signal generation circuit 50 will be omitted. Similarly, the horizontal-reference-signal masking signal generation circuit 70 shown in FIG. 23 is the same as the horizontal-reference-signal masking signal generation circuit 40 shown in FIG. 18, and so a detailed description of the horizontal-reference-signal masking signal generation circuit 70 also will be omitted.

The within-retrace-interval horizontal reference signal generation circuit 60 shown in FIG. 22 will be described below.

A horizontal synchronizing signal Hsync is putted into a terminal j of a J-K flip-flop circuit 65, while a within-display-period horizontal reference signal 50*a* is inputted to a terminal K of the J-K flip-flop circuit 65. Accordingly, if the horizontal synchronizing signal Hsync is inputted, an output terminal Q (denoted by "a" in FIG. 22) goes to its H level in synchronism with the fall of the dot clock CLK; while, if the within-display-period horizontal reference signal 20*a* is inputted, the output terminal Q goes to its L level in synchronism with the fall of the dot clock CLK. Accordingly, while the output terminal Q of the J-K flip-flop circuit 65 is at the H level, the dot clock CLK is inputted to a back porch (Hbp) counter (hereinafter referred to simply as a counter) 61.

A count value 61*a* of the counter 61 is stored in a back porch (Hbp) hold register (hereinafter referred to simply as a hold register) 62 by the within-display-period horizontal reference signal 50*a*. Since this counter 61 is reset by the horizontal synchronizing signal Hsync, the count value stored in the register 62 corresponds to the number of dot clocks CLK within the horizontal back porch time period t4 shown in FIG. 25, and it indicates the horizontal back porch time period t4.

Since the within-display-period horizontal reference signal 50*a* is inputted to the terminal K of the J-K flip-flop circuit 66, the output terminal 0 is at the L level within the display period. Since the output from the output terminal Q thereof is inputted to an AND circuit AND5, the comparison result outputted from a comparator_2 64 is masked.

In addition, within the display period, an output terminal /Q of the J-K flip-flop circuit 66 is at its H level, and the H-level output is inputted to an AND circuit AND4. However, within the display period, since the comparison result is not outputted from a comparator_1 63, there is no output from the AND circuit AND4.

As shown in FIG. 24, when the data enable signal DTMG is not inputted, the within-display-period horizontal reference signal 50*a* is not generated, and the output terminal Q of the J-K flip-flop circuit 65 is maintained at the H level until the within-display-period horizontal reference signal 50*a* for the next frame is inputted. Accordingly, when the counter 61 counts up and the count value in the comparator_1 63 reaches a count value of Ni, the comparator_1 63 outputs the comparison result. Incidentally, letting 1/CLK be one period of the dot clock CLK, N1 is selected to satisfy (1/CLK)×N1=t5.

The comparison result output from the comparator_1 63 is inputted to the AND circuit AND4, while the output from the output terminal /Q of the J-K flip-flop circuit 66 is inputted to the AND circuit AND4. However, since the output terminal /Q is at the H level, the vertical retrace interval indication signal 60*b* is outputted from the AND circuit AND4, as shown in FIG. 24.

The comparison result output from the comparator_1 63 is inputted to a terminal j of the J-K flip-flop circuit 66. When the comparison result output from the comparator_1 63 is inputted to the terminal j of the J-K flip-flop circuit 66, the output terminal Q goes to the H level and the output terminal /Q goes to its L level in synchronism with the fall of the dot clock CLK. Accordingly, the output of the AND circuit AND4 is maintained at the L level until the within-display-period horizontal reference signal 50*a* for the next frame is inputted to the terminal j of the J-K flip-flop circuit 66. Accordingly, after the vertical retrace interval indication signal 60*b* has been outputted from the AND circuit AND4, the comparison result output from the comparator_1 63 is kept from passing through the AND circuit AND4.

In the meantime, the count value 61*a* of the counter 61 is also inputted to the comparator_2 64; and, when the count value of the counter 61 coincides with the count value stored in the register 62, the comparator_2 64 outputs the comparison result. In this case, since the within-display-period horizontal reference signal 50*a* is not inputted to the register 62, the count value stored in the register 62 becomes a count value latched by the previous within-display-period horizontal reference signal 50*a* (i.e., a count value indicative of one horizontal back porch time t4).

The comparison result output from the comparator_2 64 is inputted to the AND circuit AND5, while the output from the output terminal Q of the J-K flip-flop circuit 66 is inputted to the AND circuit AND5. Since the output terminal Q is at the H level, the AND circuit AND5 outputs the within-retrace-interval horizontal reference signal 60*a* at intervals of the time t1, as shown in FIG. 24. The comparator_2 64 also outputs the comparison result within the display period, but the output terminal Q of the J-K flip-flop circuit 66 is at the L level within the display period, whereby the AND circuit AND5 is maintained at the L level. Accordingly, the comparison result output from the comparator_2 64 does not at all pass through the AND circuit AND5.

In Embodiment 3, since the number of signals to be masked, N, is N=1, as shown in FIG. 24, the last within-retrace-interval horizontal reference signal 60*a* is finally masked and the horizontal reference signal HRS is obtained. In addition, the data start latch pulse STH does not appear at a position circled in FIG. 25. In this manner, liquid crystal driving is stopped N lines before the data enable signal DTMG for the next frame is inputted. Accordingly, even if the horizontal back porch time varies to a time period t6 that is different from the time period t4 in the next frame, contention does not occur.

Incidentally, in Embodiment 3, the number of signals to be masked, N, is not limited to one, and may be one or more.

Accordingly, in Embodiment 3 as well, it is possible to perform the liquid crystal driving within the vertical retrace interval without any contention between the output sequence within the vertical retrace interval and the output sequence within the display period of the next frame after the completion of the vertical retrace interval.

Incidentally, the horizontal reference signal generation part shown in FIG. 20 is provided in the display control device 110, and this horizontal reference signal generation part uses only the data enable signal DTMG, the dot clock CLK, and the horizontal synchronizing signal Hsync. For this reason, in Embodiment 3, the vertical synchronizing signal Vsync is not needed as one of the display control signals to be inputted externally.

As is apparent from the foregoing description, in the liquid crystal display module according to each of the above-described embodiments, it is possible to set a wide variety of input modes. Accordingly, the invention can be usefully applied to, for example, liquid crystal display modules for monitors which need various input modes.

Incidentally, in the description of each of the embodiments, reference has been made to a vertical electric field type of liquid crystal display panel to which the invention is applied, but the invention is not limited to only this type a display panel and may also be applied to an in-plane switching type of liquid crystal display panel.

In the vertical electric field type of liquid crystal display panel shown in each of FIGS. 2 and 3, a common electrode ITO2 is provided on a substrate opposed to a TFT substrate; whereas, in the in-plane switching type of liquid crystal display panel, counter electrodes CT and counter electrode signal lines CL for applying a common voltage Vcom to the counter electrodes CT are provided. Accordingly, each liquid crystal capacitance Cpix is equivalently connected between a pixel electrode PX and a counter electrode CT. A storage capacitance Cstg is also formed between the pixel electrode PX and the counter electrode CT.

In the description of the embodiments, reference has been made to an embodiment which adopts a dot inversion method as a driving method, but the invention is not limited to the dot inversion method. The invention can also be applied to a plural-line inversion method or a common inversion method in which the polarity of driving voltages to be applied to pixel electrodes ITO1 and common electrodes ITO2 is inverted at intervals of one line or a plurality of lines.

Although the invention made by the present inventor has been specifically described with reference to various embodiments, it is a matter of course that the invention is not limited to any of the above-described embodiments and various modifications can be made without departing from the gist of the invention.

The representative advantages of the invention disclosed in the present application will be described below in brief.

(1) According to the invention, it is possible to prevent contention from occurring between a driving signal transmitted from a display control circuit to a driving circuit within a vertical retrace interval and a driving signal transmitted from the display control circuit to the driving circuit within the display period of the next frame after the completion of the vertical retrace interval. Accordingly, it is possible to prevent the driving circuit from malfunctioning or being destroyed.

(2) According to the invention, a gray scale voltage is outputted to each signal line from the driving circuit within a vertical retrace interval by a number of times not smaller than twice and not greater than (the number of vertical lines−N (N is arbitrary)) times. Accordingly, the voltages written in pixels are prevented from being varied and causing lateral stripes on the display screen, whereby it is possible to improve the display quality of the display screen.

What is claimed is:

1. A driving method of a liquid crystal display device having a plurality of pixels, a plurality of signal lines which apply a gray scale voltage to each of the pixels, and a driving circuit which outputs an output signal for changing the gray scale voltage applied to each of the signal lines, the method comprising the steps of:

outputting the output signal from the driving circuit during a vertical retrace interval; and stopping the outputting of the output signal from the driving circuit until completion of the vertical retrace interval;

wherein an interval from a last outputting of the output signal within the vertical retrace interval until a first outputting of the output signal at a next frame is longer than a horizontal scanning time.

2. A driving method of a liquid crystal display device according to claim 1, wherein the output signal is outputted from a beginning of the vertical retrace interval.

3. A driving method of a liquid crystal display device according to claim 1, wherein the output signal is outputted within the vertical retrace interval in synchronism with a regular horizontal synchronizing signal.

4. A driving method of a liquid crystal display device according to claim 1, wherein the output signal is outputted within the vertical retrace interval in synchronism with an internally generated horizontal synchronizing signal.

5. A driving method of a liquid crystal display device according to claim 1, wherein a polarity of the gray scale voltage is inverted at least once within the vertical retrace interval.

6. A driving method of a liquid crystal display device according to claim 1, wherein the gray scale voltage within the vertical retrace interval is a gray scale voltage for displaying white or black.

7. A liquid crystal display device comprising:

a plurality of pixels;

a plurality of signal lines which apply a gray scale voltage to each of the pixels; and a driving circuit which outputs an output signal for changing the gray scale voltage applied to each of the signal lines, wherein the driving circuit:

outputs the output signal during a vertical retrace interval, and stops the outputting of the output signal from the driving circuit until completion of the vertical retrace interval, and wherein an interval from a last outputting of the output signal within the vertical retrace interval until a first outputting of the output signal at a next frame is longer than a horizontal scanning time.

8. A liquid crystal display device according to claim 7, wherein the output signal is outputted from a beginning of the vertical retrace interval.

9. A liquid crystal display device according to claim 7, wherein a polarity of the gray scale voltage is inverted at least once within the vertical retrace interval.

10. A liquid crystal display device according to claim 7, wherein the gray scale voltage within the vertical retrace interval is a gray scale voltage for displaying white or black.

11. A liquid crystal display device comprising:

a plurality of pixels;

a plurality of signals lines which apply a gray scale voltage to each of the pixels; and a driving circuit which outputs the gray scale voltage to a plurality of pixels, wherein the driving circuit:

outputs the gray scale voltage to each of the signal lines during a vertical retrace interval, and stops the outputting of the gray scale voltage from the driving circuit to each of the signal lines until completion of the vertical retrace interval, and wherein an interval from a last outputting of the gray scale voltage within the vertical retrace interval until a first outputting of the gray scale voltage at a next frame is longer than a horizontal scanning time.

12. A liquid crystal display device according to claim 11, wherein the gray scale voltage is outputted from a beginning of the vertical retrace interval.

13. A liquid crystal display device according to claim 11, wherein a polarity of the gray scale voltage is inverted at least once within the vertical retrace interval.

14. A liquid crystal display device according to claim 11, wherein the gray scale voltage within the vertical retrace interval is a gray scale voltage for displaying white or black.

* * * * *